US010420396B2

(12) United States Patent
Hwang et al.

(10) Patent No.: US 10,420,396 B2
(45) Date of Patent: Sep. 24, 2019

(54) HEEL PROTECTOR

(71) Applicant: GOGO HEEL, LLC, Encinitas, CA (US)

(72) Inventors: Grace Hwang, Encinitas, CA (US); Nicolas Zadno, Encinitas, CA (US)

(73) Assignee: Gogo Heel, LLC, Encinitas, CA (US)

( * ) Notice: Subject to any disclaimer, the term of this patent is extended or adjusted under 35 U.S.C. 154(b) by 33 days.

(21) Appl. No.: 15/586,751

(22) Filed: May 4, 2017

(65) Prior Publication Data

US 2017/0318910 A1 Nov. 9, 2017

Related U.S. Application Data

(60) Provisional application No. 62/332,905, filed on May 6, 2016.

(51) Int. Cl.
*A43C 13/00* (2006.01)

(52) U.S. Cl.
CPC ..... *A43C 13/00* (2013.01)

(58) Field of Classification Search
CPC ..... A43B 21/22; A43B 23/30; A43C 13/00; A43C 13/12

(Continued)

(56) References Cited

U.S. PATENT DOCUMENTS 963,053 A 7/1910 Lockwood
1,039,306 A 9/1912 McDonald
(Continued)

FOREIGN PATENT DOCUMENTS

DE 3006116 A1 2/1982
EP 0388366 A2 9/1990
(Continued)

OTHER PUBLICATIONS

Plastics International—Polypropylene Homopolymer, https://www.plasticsintl.com/datasheets/Polypropylene_Homopolymer.pdf, downloaded Apr. 13, 2015.

(Continued)

*Primary Examiner* — Marie D Bays
(74) *Attorney, Agent, or Firm* — Knobbe Martens Olson & Bear LLP

(57) ABSTRACT

A shielding cup is provided for use with a self-fusing member or collapsible heat-concentrating accessory. The shielding cup is attached to a shoe heel as a temporary fix for a worn heel tip. The cup can be attached to the heel by a self-fusing member that binds to itself. The cup can also be attached by using a heat source and collapsible heat-concentrating accessory to concentrate heat on the heat-shrink version of the shielding cup. The cup can also be press fit on to the heel tip without the use of a self-fusing member or collapsible heat-concentrating accessory. Embodiments of the cup that can be press fit on to the heel tip include a rigid portion adjacent the base of the cup that engages the heel tip and a flexible portion extending away from the base of the cup. The flexible portion can be achieved by tapering the sidewalls of the cup along a longitudinal axis of the cup. Some embodiments of the cup that can be press fit on to the heel tip include a widened base having an outer periphery that is larger than an inner periphery.

38 Claims, 7 Drawing Sheets

(58) Field of Classification Search
USPC ..... 36/72 R, 72 B, 73
See application file for complete search history.

(56) References Cited

U.S. PATENT DOCUMENTS

| | | | | |
|---|---|---|---|---|
| 1,053,361 | A | 2/1913 | Cummings | |
| 1,261,525 | A * | 4/1918 | Helwitz | A43B 5/007 36/72 B |
| 1,263,555 | A * | 4/1918 | Helwitz | A43B 5/007 36/72 B |
| 1,422,446 | A * | 7/1922 | Kaplan | A43C 13/00 36/72 B |
| 1,429,428 | A | 9/1922 | Hipwood | |
| 1,439,104 | A | 12/1922 | Helwitz | |
| 1,663,622 | A | 3/1928 | Atkinson | |
| 1,875,806 | A * | 9/1932 | Givens | A43B 3/166 36/72 B |
| 1,932,056 | A | 10/1933 | Weatherhead, Jr. | |
| 1,964,049 | A | 6/1934 | Giannini et al. | |
| D126,506 | S | 4/1941 | Derry | |
| 2,875,532 | A | 3/1959 | Fitzsimmons | |
| 2,875,534 | A | 3/1959 | Grossman | |
| 2,908,089 | A | 10/1959 | Ciaio | |
| D192,994 | S | 6/1962 | Klein | |
| 3,053,357 | A | 9/1962 | Stanger | |
| 3,089,786 | A | 5/1963 | Nachtsheim et al. | |
| 3,094,793 | A | 6/1963 | Werke | |
| D195,629 | S | 7/1963 | Borah | |
| 3,122,848 | A * | 3/1964 | Grossman | A43B 3/166 36/7.1 A |
| 3,142,910 | A | 8/1964 | Levine | |
| 3,150,453 | A | 9/1964 | Tilden | |
| 3,152,408 | A | 10/1964 | Frank | |
| 3,222,801 | A | 12/1965 | Mostertz | |
| 3,439,435 | A * | 4/1969 | Fredon | A43B 3/166 36/72 B |
| 3,608,213 | A | 9/1971 | Jensen | |
| D233,507 | S | 11/1974 | Stevens | |
| 4,461,100 | A | 7/1984 | Minor et al. | |
| D293,042 | S | 12/1987 | Martin | |
| 4,750,278 | A | 6/1988 | Cates | |
| D296,720 | S | 7/1988 | Martin | |
| D301,182 | S | 5/1989 | Girardat et al. | |
| 4,848,008 | A | 7/1989 | Kuehnle | |
| 5,044,097 | A | 9/1991 | Young | |
| 5,052,129 | A | 10/1991 | Lobasso et al. | |
| 5,058,290 | A | 10/1991 | Koehl | |
| D328,419 | S | 8/1992 | Brayford | |
| 5,311,675 | A | 5/1994 | Topel | |
| 5,573,213 | A | 11/1996 | Henderson et al. | |
| 6,635,516 | B1 | 10/2003 | Komatsu | |
| 6,895,695 | B1 | 5/2005 | Chen | |
| D541,133 | S | 4/2007 | Brayford | |
| D591,033 | S | 4/2009 | Patterson et al. | |
| 7,578,075 | B1 | 8/2009 | Kemp | |
| D605,935 | S | 12/2009 | Zeyfang | |
| 7,644,719 | B2 | 1/2010 | Galanty | |
| D617,894 | S | 6/2010 | Wright | |
| 7,730,638 | B2 | 6/2010 | Urbach et al. | |
| D632,463 | S | 2/2011 | Brown et al. | |
| 8,033,035 | B2 | 10/2011 | Brown et al. | |
| 8,424,224 | B2 | 4/2013 | Hampton | |
| 8,453,351 | B1 | 6/2013 | Hale | |
| 9,107,477 | B2 | 8/2015 | Zadeh | |
| D750,880 | S | 3/2016 | Weber | |
| D752,953 | S | 4/2016 | Gundich | |
| 9,301,575 | B2 | 4/2016 | Hwang et al. | |
| D809,254 | S | 2/2018 | Hwang et al. | |
| 10,244,824 | B2 | 4/2019 | Hwang et al. | |
| 2007/0152110 | A1 | 7/2007 | Fong | |
| 2008/0060226 | A1 | 3/2008 | Rie | |
| 2008/0148606 | A1 | 6/2008 | Brown | |
| 2008/0184598 | A1 | 8/2008 | Handel et al. | |
| 2008/0196279 | A1 | 8/2008 | Epping | |
| 2008/0216363 | A1 | 9/2008 | Alexander | |
| 2009/0077757 | A1 | 3/2009 | Tameno et al. | |
| 2009/0165337 | A1 * | 7/2009 | Cohen | A43B 21/22 36/136 |
| 2009/0217553 | A1 * | 9/2009 | Jagger | A43B 21/42 36/72 B |
| 2009/0282702 | A1 | 11/2009 | Brown et al. | |
| 2011/0185601 | A1 * | 8/2011 | Hampton | A43B 23/00 36/72 B |
| 2011/0232137 | A1 | 9/2011 | Desiderio | |
| 2013/0042505 | A1 * | 2/2013 | Hwang | A43B 21/265 36/72 B |
| 2014/0033579 | A1 * | 2/2014 | Greener | A43B 23/00 36/72 B |
| 2014/0250736 | A1 * | 9/2014 | Zadeh | A43B 21/22 36/72 B |
| 2014/0259803 | A1 * | 9/2014 | Reardon | A43B 21/42 36/34 B |
| 2016/0249708 | A1 * | 9/2016 | Boag | A43C 15/04 36/72 B |
| 2016/0278483 | A1 | 9/2016 | Hwang et al. | |
| 2017/0318910 | A1 | 11/2017 | Hwang et al. | |

FOREIGN PATENT DOCUMENTS

| | | | |
|---|---|---|---|
| EP | 0479254 | A3 | 4/1992 |
| EP | 0980655 | A2 | 2/2000 |
| GB | 1298662 | A | 12/1972 |
| GB | 2171590 | A | 9/1986 |
| GB | 2217177 | A | 10/1989 |
| GB | 2419800 | A | 5/2006 |
| GB | 2428177 | | 1/2007 |
| GB | 2440442 | | 1/2008 |
| JP | 2000070005 | A | 3/2000 |
| JP | 2006034882 | A | 2/2006 |

OTHER PUBLICATIONS

Clickless, https://www.beclickless.com/, as downloaded Aug. 1, 2017.

Flash On Heels, https://www.flashonheels.com/, as downloaded Aug. 1, 2017.

Solemates, https://thesolemates.com/collections/shop-all-home-page/products/solemates-high-heeler, as downloaded on Aug. 1, 2017.

Heels Above, http://www.heelsabove.com/, as downloaded Aug. 1, 2017.

Clean Heels http://www.cleanheels.co.uk/, as downloaded Aug. 1, 2017.

Wowly High Heel Protector / Cornucopia Brands, https://www.amazon.com/gp/product/B00XD76ALU, as downloaded Aug. 1, 2017.

Heel Secure / Zipwaze, https://www.amazon.com/gp/product/B01496TNFS, as downloaded Aug. 1, 2017.

My Stiletto, https://www.mystiletto.ca/, as downloaded Jan. 16, 2018.

GoGo Heel "High Heel Protector and Heel Repair Caps", date first listed on Amazon: Jul. 18, 2015, Amazon.com, 7 pages.

Diva Dilemmas Hell Stoppers "High Heel Savers", date first listed on Amazon: Apr. 14, 2013, Amazon.com, 5 pages (2013).

* cited by examiner

HEEL PROTECTOR

CROSS-REFERENCE TO RELATED APPLICATIONS

This application claims the benefit of U.S. Provisional Patent Application No. 62/332,905, filed on May 6, 2016, entitled "HEEL PROTECTOR," which is incorporated by reference herein in its entirety.

BACKGROUND OF THE INVENTION

Field of the Invention

This application is directed to an apparatus and method for attaching an accessory to a shoe heel and more particularly is directed to attaching a replacement for a worn stiletto heel tip.

Description of the Related Art

Stiletto heels are commonly worn for fashion, as part of professional business attire, or by persons seeking additional height. These high heel shoes have a relatively narrow lower heel and a heel tip (also referred to as heel lift, dowel lift, or top piece). The heel tip is attached to the bottom of the heel post for protection against the severe abrasive pressure on the heel during normal walking. To securely fasten the heel tip to the heel, a nail stem is driven into a bore extending along the heel post. Various types of heel tips have been devised, but at the present time, conventional heel tips consist of a hard rubber part molded around a metal nail head with the nail stem protruding beyond the rubber material.

A large amount of stress and pressure is concentrated on a heel tip from the impact against the ground, especially when walking on uneven or high-friction surfaces such as concrete. Such forces, coupled with the small surface area of the heel, often cause heel tips to wear out and require frequent replacement. Worn out heel tips are an "in-the-moment" problem that continually plague shoe wearers who wear stiletto heels. Heel tip replacement, the most acceptable solution, is not an instant fix mainly because it requires pulling out the worn heel tip. Although repair at home is possible, most stiletto heel wearers do not have the equipment or expertise to perform this repair without damaging the heels and thus are compelled to take these heels to a shoe repair professional. Professional repair can take several days or a week or more. If an individual forgets to take the stiletto heel in for professional repair (or does not leave enough time for processing), the heels will either not be available or the individual will be stuck with the adverse side effects of worn out heel tips at an inopportune time. The general process of getting heel tips professionally replaced can be a hassle and big source of frustration, especially for those with a tight schedule.

Presently, a simple, instant fix for a worn out heel tip is not available to consumers. Consequently, many people delay replacement and continue to walk on worn out heel tips, sometimes wearing heels away completely until remnants of the metal nail are all that remain. Walking on worn out heel tips involves a variety of adverse side effects. First, the metal nail head can mark, scrape, and generally damage floors. Second, the metal nail head is slippery and increases the risk of sliding on smooth surfaces while walking on such surfaces. The heel tip serves as a protective buffer between the heel post, generally comprising of a vulnerable plastic material, and the ground. As a result, walking on a worn out heel tip can completely wear down the protective hard rubber layer surrounding the metal nail head, exposing the heel post to fraying, erosion, and other damage from friction. Lastly, the exposed metal nail makes a loud, distinct clicking sound as it strikes the ground during walking. This is often viewed as unprofessional in a business environment while being generally bothersome and embarrassing.

Women that work in a more formal business setting commonly wear shoes with a stiletto heel on a daily or regular basis as part of their workplace attire. Due to the frequency of wear, the issue of worn heel tips is a common problem for this group of women. With no quick and easy fix presently available, coping with worn heel tips is especially inconvenient during tightly scheduled business trips that often require being in transit, running around in airports, walking, and standing more than usual. With increased walking and standing, the loud sound of the metal nail head hitting the ground is more noticeable. This sound is distracting and projects an unprofessional image. Aside from the sound, worn out heel tips can result in a visibly unsightly appearance, as the heel post and heel fabric start to noticeably fray with continued wear.

Most commonly, there are instances when women forget to bring their shoes in for a heel tip replacement and are then stuck with the adverse side effects of worn out heel tips at an inopportune time, such as a business trip or a special occasion. This can be a very frustrating revelation with no easy fix.

In addition to the rubber heel tips wearing down frequently, narrow heels of some shoes can be unstable on uneven surfaces such as sidewalk cracks, grates, and cobblestone, potentially causing harm to the wearer and/or shoes. Additionally, walking on soft surfaces, like grass or sand, may be difficult as the narrow heel can sink into the ground and cause damage to the heel.

Prior attempts to create devices and methods for repairing or protecting heel tips fall into two categories: 1) a reconstruction of the heel tip and heel post, mostly aimed at shoe manufacturers and focused on providing an improved mode of replacing worn heel tips without special skills or tools and 2) temporary support devices that attach to heel tips primarily designed to protect the heel tip from uneven or soft surfaces and likewise protect the floor or other soft surfaces against dents and damage from heel tips, with the most notable feature being a larger, wider base for delivering support and distributing force.

The first category of heel repair is not well adapted for use by consumers without specialized skills. The second category consisting of temporary heel tip attachments has been unsuccessful for a variety of reasons, including an ineffective and cumbersome attachment mechanism.

SUMMARY OF THE INVENTION

What is presently unavailable and needed is an easy, quick solution for consumers that can offer immediate gratification, for example by providing an instant temporary fix for a worn out heel tip. This solution should be an auxiliary and/or new replacement heel tip either for temporary or permanent attachment directly over the worn heel tip. It will not require disturbing the shoe's existing structure, making the burdensome task of removing the worn heel tip unnecessary and obsolete for temporary fixes. The solution should be inexpensive for consumers, durable to resist a high friction environment, easy to apply, discreet, and should securely attach to the heel tip without the need to necessarily remove the nail or without becoming loose and falling off during use.

The embodiments discussed and within the scope of this application relate to attachable shoe accessories that serve as an auxiliary and/or new replacement heel tips that may be quickly and easily applied over the worn heel tip of a stiletto heel to avoid both the burdens of heel replacement and the adverse side effects resulting from walking on a worn out heel tip. The primary objective of the embodiments is to provide a novel solution that is easy and intuitive to apply, portable, discreet in appearance, durable for at least a short period of time, and securely anchored under a heel during normal walking. One challenge is finding a quick and effective attachment device or method. Some of the embodiments address the issue of attaching a protective device to a limited surface area that can mostly consist of a metal nail. It also provides a solution for protecting the heel from a large concentration of pressure and force. The embodiments reside not in any one feature, but rather in the particular combinations of all of them herein disclosed and claimed. The elements of various embodiments described herein are a durable shielding cup and a device or method for securely attaching the cup over the worn heel tip such that it can withstand the immense abrasive pressures generated during normal walking. Embodiments described herein can be configured to protect the heel without disturbing the existing structure of the shoe. In one embodiment, a shielding cup provided for attaching to a stiletto heel serves as a replacement heel tip that may be quickly and easily applied over the worn heel of a stiletto high heel to avoid or defer for some period of time both the burdens of replacement and the adverse side effects resulting from walking on a worn out heel tip. The shielding cup can comprise one or more of a high-density polyethylene, polyurethane, polycarbonate, acrylonitrile butadiene styrene (ABS), or any abrasion resistant material known to those skilled in the art. The walls of the cup can have a lower durometer than the base of the cup. In such embodiments, the walls are more flexible to accommodate different heel sizes. The cup may be attached to the heel by one or more layers of adhesive covering the inner cavity of the cup. This embodiment can be instantly applied anywhere without any special tools or skills, and it would provide an instant layer of protection between the worn heel tip and ground. Additionally, the cup preferably is configured to be discreet once applied. The existing nail or the heel tip may or may not be removed for this solution.

In another embodiment, the shielding cup is attached to the heel by using an elongated self-fusing member and/or adhesives to wrap around the cup and heel to bind them together. Like the first embodiment, this embodiment can be instantly applied anywhere without any other tools or prior knowledge, and it would provide an instant layer of protection between the worn heel tip and ground. Additionally, the cup and self-fusing member can be fashioned to be discreet once applied.

More particularly, the shielding cup is made of a durable, abrasion-resistant material, such as a high durometer polyurethane or a composite such as two polymers or a polymer-metal combination. The side walls can have a lower durometer than the base to allow for more flexibility in the side walls. Additionally, the cup can have features to accommodate different heel sizes and provide for easier insertion or attachment of the heel. These include, but are not limited to, a plurality of steps within the cup, a friction-enhancing surface on the exterior side walls of the cup, slits on the side walls, an adhesive lining within the cup, and an open top with a wider inner perimeter than the heel base. The walls of the cup can also be tapered to make it less noticeable when attached. Tapering can be provided in several ways. For example, the walls can taper or be inclined toward the center of the cup. One can consider this a tapering of the width or profile of the cup. In some embodiments, the thickness of the walls taper, e.g., the walls are thicker toward the bottom and thinner near the top. The walls also can be inclined and have tapering wall thickness in some embodiments. Also, the walls can taper in a non-uniform fashion along the walls such that, for example, one portion (e.g., one-half) of the cup can have a different degree of taper than another portion (e.g., one-half). Other techniques could be applied to provide better adhesion to various heel sizes. One can increase the heel diameter by wrapping some tape or pour polymers around the heel or inside the cup to take any slack between the heel and the cup.

The shielding cup is attached to an exposed heel to temporarily, or for an extended period of time, protect it from wear. This is accomplished by inserting the heel into the open top of the cup. After the cup is applied, the side walls of the cup should cover the sides of the heel but not extend over the entire heel.

An elongate self-fusing member can wrap around the heel tip area before the cup is attached to fill in any empty space between the cup and a smaller sized heel tip. Additionally, the elongate self-fusing member can be attached to securely bind the cup to the heel. The self-fusing member is stretched and contracted around a portion of the cup and heel. The cross-linking property of the self-fusing member activates when exposed to a catalyst. This allows the member to self-fuse in one minute or less.

In another embodiment, the shielding cup is made of a thermoplastic material and is attached by a heat-shrink method, heat, and/or adhesives to attach the cup to the heel. This embodiment requires a hot air hair dryer (also referred to as blowdryer) or a similar heat source for application. By using a blowdryer and collapsible heat-concentrating accessory to direct heat to the shielding cup, the thermoplastic material shrinks and conforms to the shape and size of the worn out heel tip. Although the application time would be short, this embodiment would be an "at home" solution rather than an "on the go" solution.

In particular, in one embodiment the side walls can have a lower durometer than the base which allows for more flexibility in the side walls. Additionally, the cup can have features to accommodate different heel sizes and provide for easier insertion or attachment of the heel. These include, but are not limited to, a plurality of steps within the cup, an adhesive lining within the cup, and an open top with a wider inner perimeter than the heel base. The walls of the cup can also be tapered to make it less noticeable when attached. For example, the walls can be inclined toward the center of the cup, e.g., making the cup wider at the base and narrower at the rim. Also, or alternatively, the cup can have tapered (or varying thickness) walls.

This embodiment has heat-shrink properties that allow it to constrict by at least a ratio of 2:1. The heat-shrink cup is attached to an exposed heel to temporarily protect it from wear. This is accomplished by inserting the heel into the open top of the cup. After the cup is applied, the side walls of the cup should cover the sides of the heel but not extend over the entire heel. The cup is then attached by a heat-shrink method utilizing off-the-shelf nozzles or heat source or more custom designs such as a collapsible heat-concentrating accessory.

Various materials could be used in the construction of the different embodiments. The structure configured to shrink can include a heat-shrink thermoplastic material. In particular, the heat-shrink cup can be manufactured from a thermoplastic material such as polyolefin, fluoropolymer (such as FEP, PTFE or Kynar), PVC, neoprene, silicone elastomer or Viton. The thermoplastic parts could be reinforced with another material such as a metal or another polymer. The shielding cup can have a composite structure with the lower part being harder than the upper section. This can be achieved either mechanically by creating a tapered structure, cuts or ridges in the walls of the cup, or molding and joining two dissimilar plastics or materials together. Such materials could be polycarbonates, nylon, acetal, polyurethane, silicone, Pebax™, rubber or other materials with similar properties. The adhesives could be natural or synthetic, binding by use of a solvent that evaporates or a chemical reaction between two or more constituents.

In another embodiment, a heat-shrink embodiment of the cup is attached using a heat source and collapsible heat-concentrating accessory. The accessory has a narrow opening that is adapted for holding a stiletto heel and a wider opening adapted for directing heat toward the narrow opening. The narrow opening has a screen base and a plurality of holes above the base that serve to direct heat. Once the heat-shrink cup with the heel inserted is placed on the screen base, a heat source is placed into the wider opening and used to heat the cup. The heat source should reach a temperature of at least 60 degrees Celsius while heating the cup. The cup attaches to the heel by shrinking and conforming to the shape and size of the heel.

The embodiments described herein are highly functional for their intended purpose and are designed to be discreet by emulating the appearance of a heel tip. Furthermore, they can be manufactured at a low cost. Other combinations of materials or shrink tubing and various kinds of an elongate member could also be used.

In some variations, an apparatus that attaches to a stiletto or other heel to cover an exposed heel is provided. The apparatus includes a shielding cup and an elongate member. The shielding cup has a bottom base of durable, abrasion-resistant material, side walls extending away from the bottom base to an open top that serves as the receiving end of the cup. The open top has an outer perimeter not substantially smaller than the perimeter of the bottom base. When applied to the heel tip, the side walls of the cup enclose the sides of the heel without extending over the entire heel. The elongate self-fusing member has a first end and a second end and can comprise a crossed-linked material that stretches and contracts. When portions of the self-fusing member are brought into contact while the elongate member is stretched, the contacting portions bind together to create a substantial force transverse to the heel to secure the shielding cup to the heel. In one case, a zone of overlap between the first end and to the second end is provided upon contact. The zone of contact can be a short length near the first and second ends or a longer length approaching or exceeding the length of the perimeter of the heel tip.

In some variations, an elongate member can be configured to take up or fill a space between the shielding cup and the heel. In further variations, an elongate member can be configured either to take up space or to secure the shielding cup to the heel. For example a first length of the elongate member can be positioned between the cup and the heel while a second length can be used to secure the cup to the heel.

In another embodiment, a method for repairing a stiletto heel is provided. The stiletto heel includes a heel tip disposed at the end of a heel post. The heel post has a first end coupled with the stiletto shoe and a second end adjacent to the tip. In the method, a shielding cup is provided, the cup having a bottom base of durable, abrasion-resistant material, side walls extending away from the bottom base to an open top. The open top has an inner perimeter and an outer perimeter not substantially smaller than the perimeter of the bottom base. The shielding cup is placed over the heel tip, or over the heel tip and a portion of the heel post such that the heel tip is covered and the open top is disposed between the first and second end of the heel post. The placement of the cup can be such that the open top is at a location closer to the second end of the heel post than the first end of the heel post.

Thereafter, in some embodiments, heat is applied to the shielding cup to cause the shielding cup to shrink and conform to the shape and size of the heel, e.g., to the heel post in the vicinity of the open top, to securely connect the shielding cup to the heel. The shielding cup provides a replacement heel tip.

In other variations of the method, a spacer is positioned between an inner surface of the side walls and an outer surface of the heel to improve the fit therebetween. Thereafter, the cup can be secured to the heel, e.g., by applying heat or by positioning an elongate member on one or both of the heel and the cup. As discussed below, the elongate member can be a self-fusing member or an adhesive member.

In another embodiment, an apparatus is provided that attaches to a stiletto heel to temporarily cover an exposed or worn heel. The apparatus includes a shielding cup having a bottom base of durable, abrasion-resistant material and side walls extending away from the bottom base to an open top. The open top serves as the receiving end of the cup. The open top has an inner perimeter greater than the outer perimeter of the heel base and an outer perimeter not substantially smaller than the perimeter of the bottom base. The shielding cup comprising a structure configured to shrink to cause at least the open top to constrict by at least a ratio of 2:1 in a direction transverse to the heel. When the shielding cup is applied to the heel tip, the side walls of the cup enclose the sides of the heel without extending over the entire heel.

Various embodiments described herein are directed to slip-on shoe accessories that serve to repair, protect, and/or stabilize a stiletto heel. An objective of the embodiments described herein is to provide a solution that is highly functional, easy-to-use, inexpensive to manufacture, discreet in appearance, and securely attaches to the heel during normal walking on various surfaces (e.g. concrete sidewalk, carpet, grass, cobblestone). Embodiments described herein can protect the heel without disturbing the existing structure of the shoe, eliminating the burdensome task of removing the worn heel tip for repairs. One challenge is finding a quick, effective, and discreet method for attaching a heel accessory to a tiny surface area where a lot of force and stress is concentrated.

The embodiments described herein can address the challenges of attaching a discreet, repair device to a limited surface area that can mostly consist of the leftover metal nail of an old heel tip to serve as a new replacement heel tip. Some embodiments described herein can substantially increase the ground contacting surface area of the heel to provide added stability and support when walking on uneven and/or soft surfaces. The advantages/improvements provided by the different embodiments described herein reside not in any one feature, but rather in the particular combinations of various features that are disclosed and claimed.

One novel aspect of the invention is implemented in an embodiment of a shielding cup comprising sidewalls that are configured as a press fit mechanism to securely attach the cup to a heel tip. The external sidewalls of the shielding cup are tapered along a longitudinal axis of the shielding cup from the base of the cup towards the top of the cup while the internal sidewalls are substantially straight along the depth of the cup such that the sidewall thickness is reduced from the base of the cup towards the top of the cup. In various embodiments, the external sidewalls can be linearly tapered so that an upper section near the open top is substantially thinner than a lower section near the bottom base of the cup. The tapered sidewalls can gradually decrease the mechanical resistance of the sidewalls from the base of the cup towards the top of the cup. This can advantageously facilitate smoothly press fitting the heel into the cup. The thinner sidewalls adjacent the open top can allow for easy initial insertion of a heel wider than the width of the open top and serve as a positioning mechanism during the process of press fitting the heel into the cup. The thicker sidewalls adjacent the bottom of the cup renders the base of the cup more rigid such that it applies a high level of pressure and resistance against the heel to create a tight press fit engagement. The heel post of a stiletto heel typically gets wider higher on the heel, so when the heel is fully inserted into the tapered shielding cup, the engagement between the open top and heel post is tightened, further enhancing the press fit engagement. The press fit engagement is stronger at the thicker sidewall portion adjacent the bottom base where the mechanical resistance of the structure is higher. This is advantageous because when the heel strikes the ground, force is concentrated on the lower portion of the sidewalls adjacent to the bottom base. Accordingly, additional support provided by the increased thickness of the sidewalls in the lower portion of the bottom base can help prevent the sidewalls from rupturing.

In addition to facilitating an easy and effective press fit process, tapering the thickness of the cup as described herein also helps distribute forces more uniformly along the sidewalls. Since the heel tip area is a high impact walking surface, having thicker sidewalls adjacent the bottom base can withstand the forces experienced while walking thereby preventing the heel from breaking through the cap walls.

Various embodiments of the shielding cup described herein can have an open top perimeter that is not substantially smaller than the base perimeter, so that it's discreet to use for repairing or protecting a heel tip without being noticeable on the heel.

Some embodiments described herein comprise a shielding cup that has a widened base having an inner periphery adjacent the sidewalls and an outer periphery surrounding the inner periphery. The inner periphery can have a width that is not substantially larger than a width of the open top while the outer periphery can have a width that is between 1.5-4 times the width of the inner periphery. The external surface of the bottom base between the inner periphery and the outer periphery can be inclined such that a thickness between the bottom surface of the bottom base and the inner periphery is larger than a thickness between the bottom surface of the bottom base and the outer periphery. The shielding cup having a widened base can increase the surface area of the bottom surface that contacts the ground which can provide stability and/or aid walking on uneven or soft surfaces (e.g. grass, sand, etc.) without sinking. Tapering the thickness of the external surface of the bottom base between the inner periphery and the outer periphery can provide additional structural strength to prevent the shielding cup from warping during normal walking. A flat base having a uniform thickness can be flimsy and deform during normal walking, especially on uneven or soft surfaces. Having a tapered base structure where the base thickness gradually increases inward towards the inner periphery can reinforce the base so that it retains its shape during normal walking. The outer periphery can have any shape, such as a circle or flower-shaped.

The embodiments described herein advantageously allow a one material system to create flexible and rigid areas in contrast to embodiments that used at least two different materials. For example, the shielding cup can comprise a rigid material that is rendered flexible in some areas of the shielding cup by reducing a thickness of the sidewall. By using one rigid material to construct the cup, some portions of the cup (e.g., sidewalls adjacent the bottom base) can be configured to be stronger to prevent the heel from puncturing it while some other portions (e.g., sidewalls adjacent the open top) can be configured to be flexible.

In some embodiments, the shielding cup attaches to the heel through use of a method of press fit optimization between the cup and the heel tip of a stiletto shoe. In such embodiments, the thickness of the sidewalls can be configured to be flexible to facilitate an easy, effective press fit system.

Various embodiments of the shielding cup can comprise one or more of a high-density polyethylene, polyurethane, TPU, polycarbonate, acrylonitrile butadiene styrene (ABS), or any abrasion resistant material known. The walls of the cup can have a lower durometer than the base of the cap. In such embodiments, the walls are more flexible to accommodate different heel sizes. The cap may be attached to the heel by one or more layers of adhesive covering the inner cavity of the cup. Additionally, the cup can be configured to be discreet once applied. The existing nail or the heel tip may or may not be removed prior to attaching the cup over the heel tip.

BRIEF DESCRIPTION OF THE DRAWINGS

The structures and methods of using certain embodiments of the inventions will be better understood with the following detailed description of embodiments of the invention, along with the accompanying illustrations, in which:

FIG. 2L-1 is a perspective view of an embodiment of a shielding cup with tapered sidewalls. FIG. 2L-2 is a side view of the embodiment of the shielding cup illustrated in FIG. 2L-1. FIG. 2L-3 is a cross-sectional view of the embodiment of the shielding cup illustrated in FIG. 2L-1. FIG. 2L-4 is a top view of the embodiment of the shielding cup illustrated in FIG. 2L-1. FIG. 2L-5 is a bottom view of the embodiment of the shielding cup illustrated in FIG. 2L-1.

FIG. 2M-1 is a perspective view of an embodiment of a shielding cup with tapered sidewalls and a widened base. FIG. 2M-2 is a side view of the embodiment of the shielding cup illustrated in FIG. 2M-1. FIG. 2M-3 is a cross-sectional view of the embodiment of the shielding cup illustrated in FIG. 2M-1. FIG. 2M-4 is a top view of the embodiment of the shielding cup illustrated in FIG. 2M-1. FIG. 2M-5 is a bottom view of the embodiment of the shielding cup illustrated in FIG. 2M-1.

FIG. 2N-1 is a perspective view of an embodiment of a shielding cup with tapered sidewalls and a widened flower-shaped base. FIG. 2N-2 is a side view of the embodiment of the shielding cup illustrated in FIG. 2N-1. FIG. 2N-3 is a cross-sectional view of the embodiment of the shielding cup illustrated in FIG. 2N-1. FIG. 2N-4 is a top view of the embodiment of the shielding cup illustrated in FIG. 2N-1. FIG. 2N-5 is a bottom view of the embodiment of the shielding cup illustrated in FIG. 2N-1.

DETAILED DESCRIPTION OF THE PREFERRED EMBODIMENT

Figure 1:
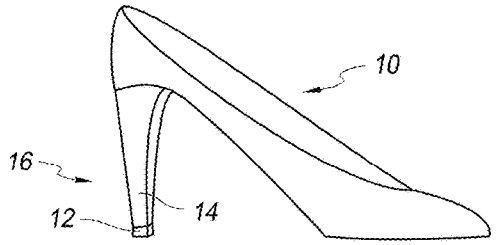
FIG. 1 is a representation of a high heel stiletto shoe.

FIG. 1 represents a stiletto shoe 10 of conventional construction. The heel 16 of the shoe comprises of a heel post 14, which can be covered by a fabric layer, and a heel tip 12. The heel tip 12 is typically made of a hard rubber material such as polyurethane and is secured to the heel post 14 by a metal nail 28 (see FIG. 3A) that is embedded in the rubber material. The heel tip 12 may represent all degrees of wear, ranging from brand new to severely worn, where the bottom of the heel post 14 is exposed and mutilated from impact with the ground. In a severe degree of wear, the metal nail 28 is all that remains of the heel tip 12. Various embodiments described herein are configured to attach over the lower part of the heel 16 and protect it from wear. The embodiments described herein can be configured to provide stability when walking on uneven or softer surfaces.

The heel protector of some of the embodiments includes a shielding cup 18, 18*a* comprising of flexible side walls 22 and attached to the heel 16 by a layer of adhesive 24, by radial force applied by tapering walls, or by an elongate self-fusing member 26. In some embodiments, the shielding cup 18, 18*a* attached to the heel 16 through use of a collapsible heat-concentrating accessory 30 and method of heat-shrinking said cup 18, 18*a* to the heel 16.

A. Shielding Cup Attached by an Elongate Member

The shielding cup 18, 18*a* may be formed of any suitable structural material such as hard rubber, plastic, metal, and/or nylon. Suitable materials include high-density polyethylene, polyurethane, polycarbonates, acrylonitrile butadiene styrene (ABS), thermoplastic polyurethane (TPU) or any abrasion resistant material. The shielding cup 18, 18*a* can be reinforced with another material such as a metal or another polymer. The base 20 of the cup 18, 18*a* is typically about 1 mm to about 4 mm in thickness and has a maximum width (e.g., diameter) ranging from about 7 mm to about 16 mm. The side walls 22 of the cup 18, 18*a* range from about 1 mm to about 3 mm in thickness and about 4 mm to about 12 mm in depth inside the cup. These dimensions cover the common range of stiletto heel tip sizes and are designed to emulate the appearance of a heel tip to avoid noticeability. The thickness of the side walls 22 may be uniform or tapered, for example, having a varying dimension along a direction that extends upwardly toward the open top of the shielding cup 18, 18*a*.

In one embodiment, the cup 18 has a depth from an open top to a substantially flat base inside the cup of between about 4 mm and about 8 mm, with straight side walls 22. In this embodiment, there preferably is one or more ridges on the exterior surface of at least a portion of the walls 22. Preferably this embodiment comprises polyurethane or other material having a hardness of about 90 shore A. This cup embodiment can be coupled with any of the elongate members described herein, which can be used to take up space between the cup 18 and the heel, to secure the cup 18 to the heel, or both to take up space and secure the cup 18 to the heel. In one embodiment, the cup 18 is provided with an elongate member that is between about 5 cm and about 10 cm long and that is between about 6 mm and about 25 mm wide.

Figure 2A:
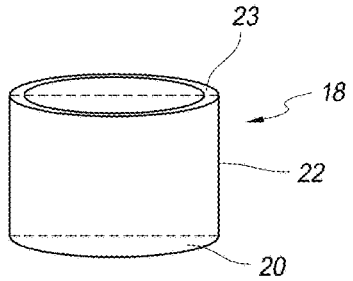
FIG. 2A is a perspective view of an embodiment of the shielding cup of the heel protector according to one embodiment of the invention.
Figure 2B:
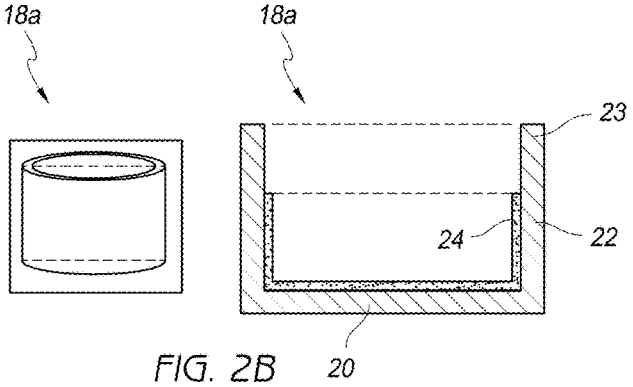
FIG. 2B is a perspective and cross sectional view of another embodiment of the shielding cup with an adhesive layer applied to the base and lower portion of the cup's side walls.
Figure 2C:
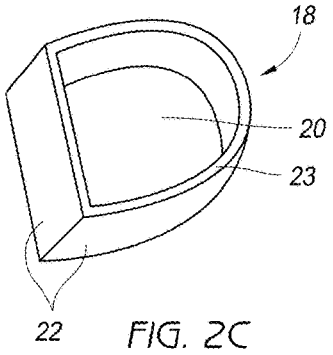
FIG. 2C is a top view of the base of the shielding cup shaped like a horseshoe, a common heel shape.

The cup 18, 18*a* includes a base 20 and side walls 22 which form a circle in FIGS. 2A and 2B but form a horseshoe or D-shape in FIG. 2C. The shielding cup 18, 18*a* is not limited to these two shapes, but varies to accommodate different heel shapes. The base 20 and side walls 22 of the shielding cup 18, 18*a* connect to form an open top with a top rim 23 and cavity for receiving the lower end of a heel 16. The base 20 of the cup 18, 18*a* may be flat or concave upward. The cup 18, 18*a* serves to provide a barrier between the heel 16 and ground, protecting the heel tip 12 or nail 28 from impact and abrasion caused by contact with the ground.

Figure 2D:
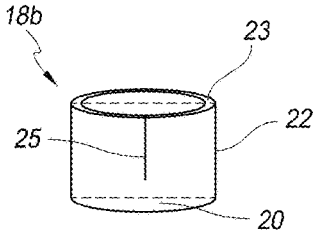
FIG. 2D is a perspective view of the shielding cup in FIGS. 2A and 2B, shown with slit(s) in the walls.
Figure 2E:
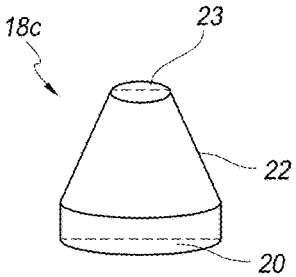
FIG. 2E is a side view of the shielding cup in FIGS. 2A and 2B, shown with the walls of the shielding cup tapering inward toward the center.
Figure 2F:
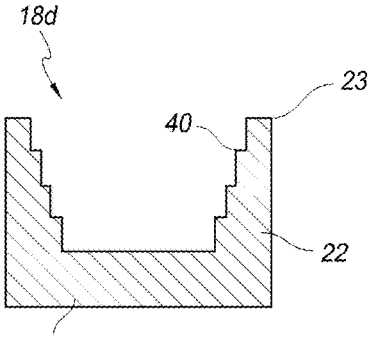
FIG. 2F is a cross sectional view of the shielding cup in FIGS. 2A and 2B, shown with the inner cavity of the shielding cup including steps.

In another embodiment shown in FIG. 2F, the inner cavity of the shielding cup 18*d* can comprise of steps 40 to further accommodate different heel sizes. Each level of steps 40 can form a perimeter conforming to the shape of the shielding cup 18*d* and gradually increases in perimeter as the steps 40 extend upward to the open top. Alternatively, steps 40 closer to the base 20 can have a shape conforming to the nail 28 or other internal structure and steps 40 closer to the top rim 23 can have a shape conforming to that of the top rim 23. The steps 40 collectively form a plurality of flat surfaces that are oriented to securely hold heels of different sizes. The flat steps 40 will allow the bottom of the heel 16 to stay parallel to the bottom base 20 of the cup 18*d*.

In the embodiment of FIG. 2D, the side walls 22 of the shielding cup 18*b* may have one or multiple slits 25 that run perpendicular or in an oblique manner to the base 20. These slit(s) 25 provide flexibility or slack to the upper portion of the cup so it can accommodate a range of heel sizes, including some sizes that are larger than an unexpanded size of the rim 23. The slit(s) 25 may be contiguous with the edge of the cup's top rim 23, e.g., having an upper end at the rim 23, a lower end disposed between the top rim 23 and the base 20 and a length there between. The length of the slit 25 can be between about 50% and about 75% of the depth of the cup 18. In other embodiments, the slit 25 can be disposed in between the top rim 23 and the base 20. The slits could also be deep enough to go through the thickness of the wall. In this case it is important to have enough strength in the wall to avoid premature rupture.

Figure 2G:
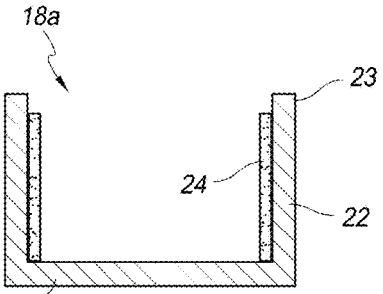
FIG. 2G is a cross sectional view of the shielding cup in FIGS. 2A and 2B, shown with the side walls covered with a layer of adhesive.
Figure 3A:
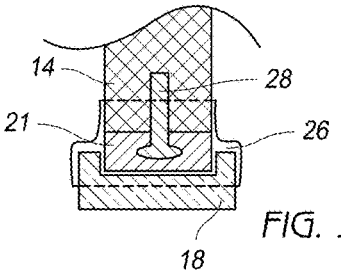
FIG. 3A is a cross sectional view of an embodiment of FIG. 2A or 2C attached to the lower part of the heel by an elongated self-fusing member.
Figure 3B:
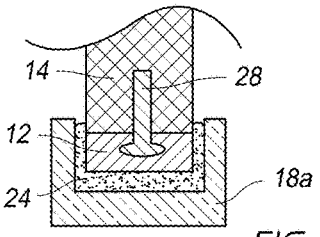
FIG. 3B is a cross sectional view of the shielding cup in FIGS. 2A and 2B attached to the lower part of the heel by an adhesive layer.

In other embodiments of the shielding cups 18, 18*a* shown in FIGS. 2B, 2G, and 3B, either the side walls 22 or both the side walls 22 and the base 20 may be covered with a layer of adhesive 24. The adhesive 24 extends upwardly from the base 20 to approximately one-half to the full height of the inner surface of the side wall 22.

In another embodiment shown in FIG. 2E, the shielding cup 18*c* has side walls 22 that taper or angle inward toward the center such that the diameter of the base 20 may be substantially larger than the relaxed diameter of the cup's top rim 23 but not substantially larger than the expanded diameter of the cup's top rim when a heel tip is inserted. The base 20 may be flat or concave upward as shown in FIG. 2I. The concave shape of the inside base 41 of shielding cup 18*f* accommodates heels with concave bases or extremely damaged heels that have an exposed nail.

The diameter of the cup's top rim 23 may be stretched to a diameter equivalent or greater than the diameter of the base 20. Inserting a heel tip 12 and/or heel post 14 with a diameter larger than the relaxed diameter of the cup's open rim 23 will constrict the cup 18*c* around the heel tip 12 and/or heel post 14, providing radial force to secure the cup 18*c* to the heel 16. In this embodiment shown in FIG. 2E, an elongate self-fusing member 26 may not be required to secure the cup 18*c* to the heel 16.

Figure 2H:
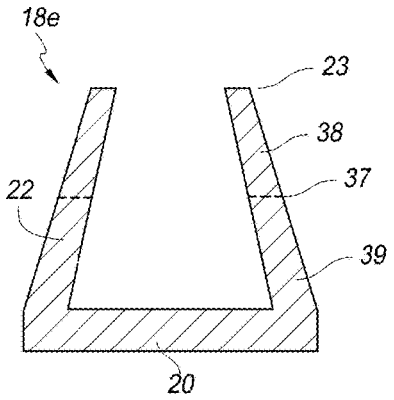
FIG. 2H is a cross sectional view of a variation of the shielding cup in FIGS. 2A, 2B, and 2E, shown with an upper portion of the side walls having a lower durometer than the lower portion of the side walls and base.
Figure 2I:
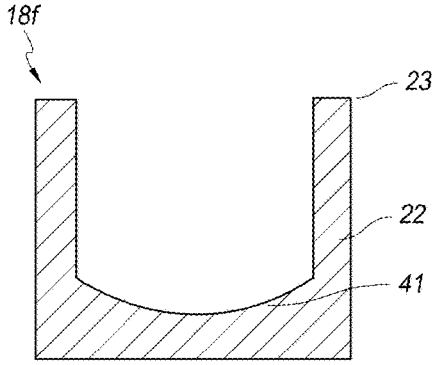
FIG. 2I is a cross sectional view of a variation of the shielding cup in FIGS. 2A and 2B, shown with an inside base with a concave surface.

In another embodiment shown in FIG. 2H, the shielding cup 18*e* has side walls 22 with a tapered upper portion 38. This upper portion 38 can have a lower durometer than the bottom portion 39 of the side walls 22 and base 20. The lower durometer provides more flexibility to the upper portion 38 of the cup 18*e* to accommodate different heel sizes. A transition line or zone 37 is provided between the lower durometer portion and a higher durometer portion disposed below the line or zone 37. The higher durometer portion is configured to be more robust and wear resistant. The lower durometer can be achieved by providing two materials with different durometers such as 90 shore A and 60 shore A, by mechanically changing the property of the upper section such as by reducing the thickness, or by other known techniques. An embodiment of a shielding cup in which the flexibility of the upper portion is increased by reducing the thickness of the sidewalls in the upper portion is discussed below.

Figure 2J:
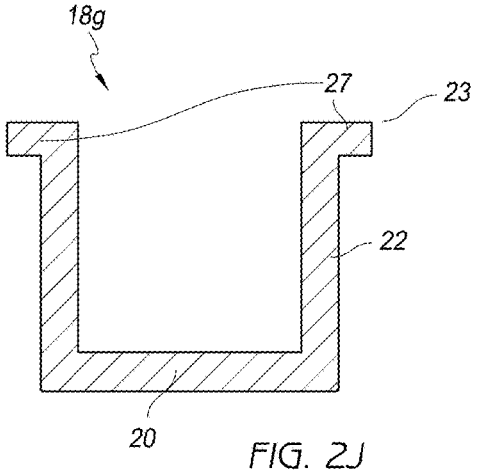
FIG. 2J is a cross sectional view of the shielding cup in FIGS. 2A and 2B, shown with an example of a friction-enhancing structure on the exterior side walls of the cup.
Figure 2K:
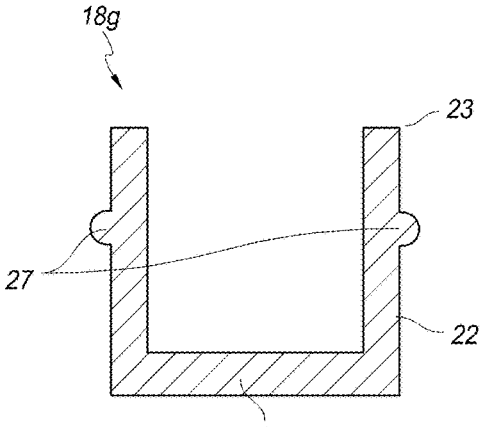
FIG. 2K is a cross sectional view of the shielding cup in FIGS. 2A and 2B, shown with another example of a friction-enhancing structure on the exterior side walls of the cup.
Figures 1, 2L:
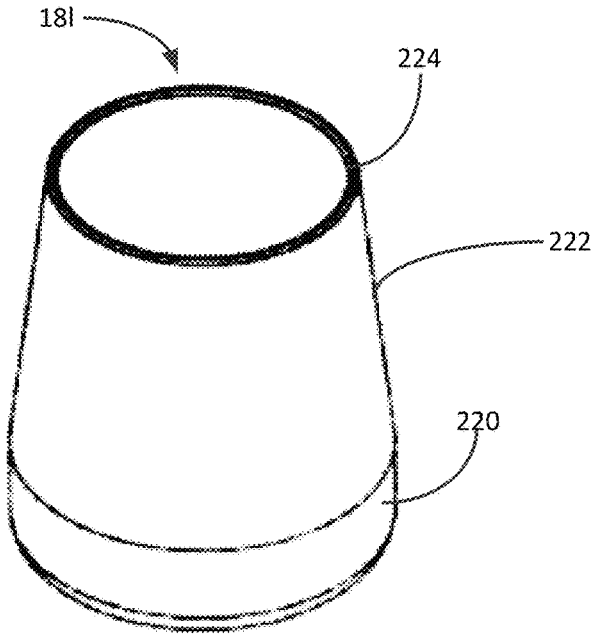
Figures 2, 2L, 3, 4:
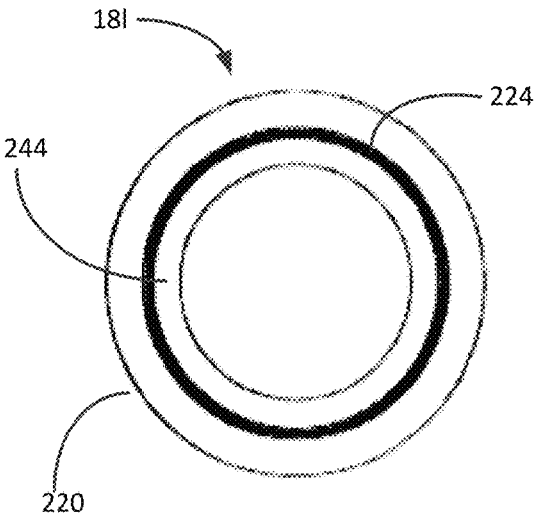
Figures 2, 2L, 3, 4, 5:
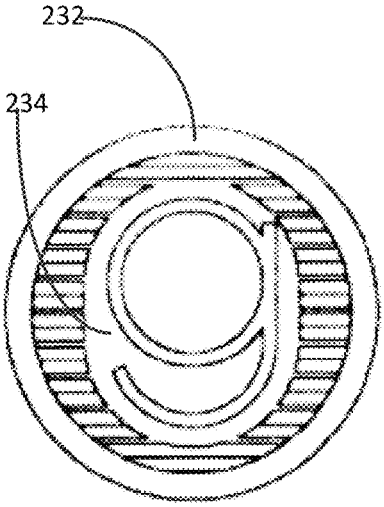
Figures 2, 2L:
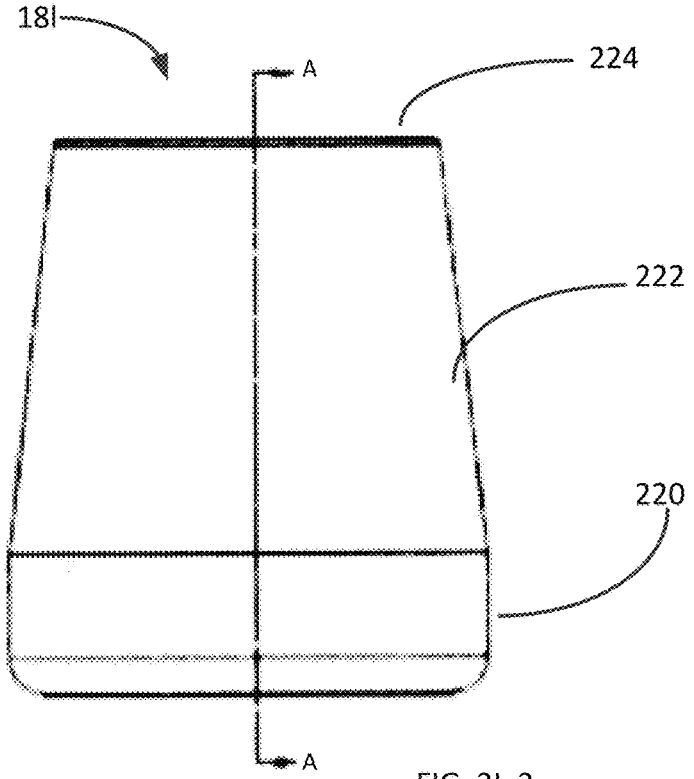
Figures 2, 2L, 3:
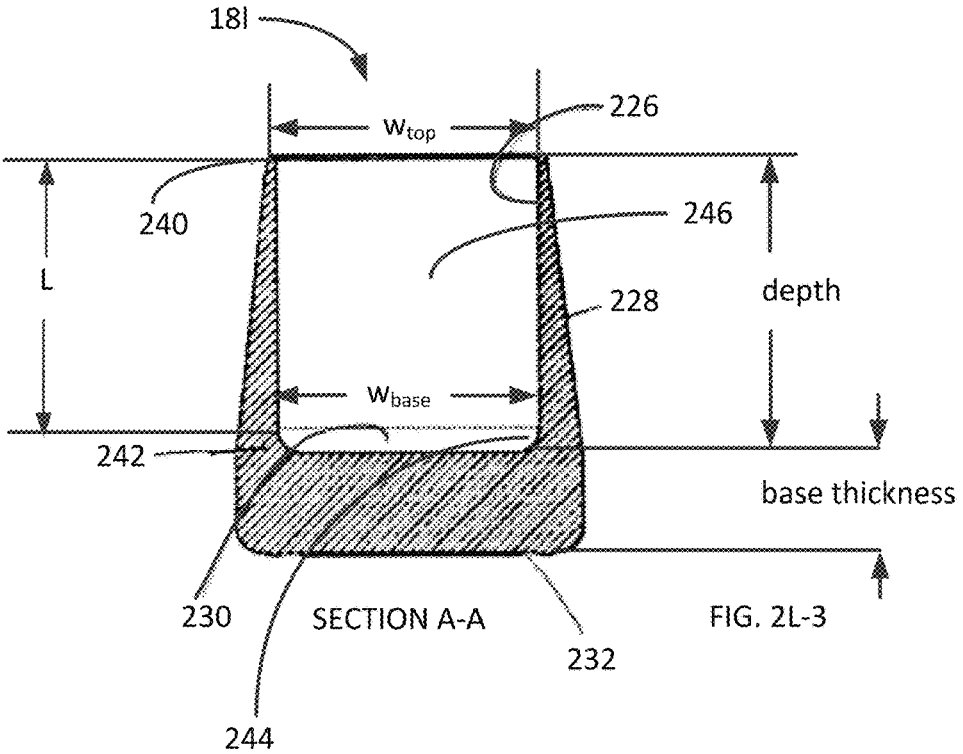

FIG. 2L-1 is a perspective view of an embodiment 18*l* of a shielding cup with tapered sidewalls. The shielding cap 18*l* can be used for repairing and/or protecting a heel tip 12 of a stiletto 10. The shielding cup 18*l* has an open top 224, a bottom base 220 and sidewalls 222 extending from the bottom base 220 to the open top 224. FIG. 2L-2 is a side view of the embodiment 18*l* of the shielding cup illustrated in FIG. 2L-1 along a longitudinal axis A-A intersecting the top 224 and the base 220. FIG. 2L-3 is a cross-sectional view of the embodiment 18*l* of the shielding cup illustrated in FIG. 2L-1 along the axis A-A. In various embodiments, the shielding cup can be rotationally symmetric about the longitudinal axis A-A. In some embodiments, the shielding cup can have 2-fold or 4-fold symmetry about the longitudinal axis A-A. The embodiment 18*l* of the shielding cup can serve to provide a barrier between the heel 16 and ground, protecting the heel tip 12 or exposed metal nail from impact and abrasion caused by contact with the ground.

The bottom base 220 can have an inner surface 230 that can contact the base of the heel tip 12 when the shielding cup 18*l* is placed over the heel tip 12 and an external base surface 232 that is configured to contact the ground or the floor when the shielding cup is placed over the heel tip of a stiletto shoe. The inner surface 230 can be flat or curve upward towards the open top 224 (e.g., concave as shown in FIG. 2I). The sidewalls 222 of the shielding cup 18*l* comprise inner sidewalls 226 and outer sidewalls 228. The inner sidewalls 226 and the inner surface 230 of the bottom surface can bound an inner cavity 246 that is configured to receive the heel tip 12 and/or a portion of the heel post 14. The open top 224 comprises an inner perimeter formed by the portion of the inner sidewalls 226 adjacent the open top 224 and an outer perimeter formed by the portion of the outer sidewalls 228. The bottom base 220 also comprises an inner perimeter formed by the portion of the inner sidewalls 226 adjacent the inner surface 230 and an outer perimeter formed by the portion of the outer sidewalls 228 adjacent the bottom base 220. In various embodiments, the outer perimeter of the open top 224 is not substantially smaller than the outer perimeter of the bottom base 220 so that it is discreet and/or blends with the natural shape of the heel 16. For example, the outer perimeter of the open top 224 can be within ±30% of the outer perimeter of the bottom base 220. As another example, the outer perimeter of the open top 224 can be equal to the outer perimeter of the bottom base 220 within manufacturing tolerance.

The inner and/or outer perimeter of the bottom base 220 can have a variety of shapes including but not limited to circular, oval, D-shaped, square or rectangular. The inner and/or outer perimeter of the open top 224 can have a variety of shapes including but not limited to circular, oval, D-shaped, square or rectangular. The inner perimeter of the bottom base 220 or the open top 224 can have the same shape as the corresponding outer perimeter of the bottom base 220 or the open top 224, in some embodiments. In some other embodiments, the inner perimeter of the bottom base 220 or the open top 224 can have a different shape from the corresponding outer perimeter of the bottom base 220 or the open top 224. The shape of the inner perimeter and/or the outer perimeter of the bottom base 220 or the open top 224 can be configured to accommodate different shapes and sizes of heel tips 12 and/or heel posts 14. In some embodiments, the shape of the inner perimeter and/or the outer perimeter of the bottom base 220 or the open top 224 can be configured to provide stability while walking on different surfaces, to improve the fit between the heel tip/heel post and the shielding cup and/or for aesthetic or decorative purpose. In some other embodiments, the inner sidewalls 226 and/or the outer sidewalls 228 can be discontinuous. For example, the inner sidewalls 226 and/or the outer sidewalls 228 can include grooves, ridges, slits, bumps, steps or some other features as discussed above with reference to FIGS. 2F, 2J and 2K that render the surfaces of the inner sidewalls 226 and/or the outer sidewalls 228 to be discontinuous. In some embodiments, the inner sidewalls 226 and/or the inner surface 230 of the bottom base 220 can include a layer of adhesive as discussed above with reference to FIGS. 2B and 2G. The adhesive layer can extend upwardly from the inner surface 230 to approximately one-half to the full height of the inner sidewalls 226. In some other embodiments, the outer surface 232, the outer sidewalls 228, the inner sidewalls 226 and/or the inner surface 230 can include friction-enhancing structures, as discussed above.

The inner perimeter of the open top 224 can have a relaxed cross-sectional width $w_{top}$ measured along a transverse axis perpendicular to the longitudinal axis A-A and a cross-sectional base width $w_{base}$ measured along the same transverse axis perpendicular to the longitudinal axis A-A when the shielding cup 18*l* is not attached to or placed on the heel tip 12. The shielding cup can be configured such that the relaxed width $w_{top}$ can be substantially equal to the base width $w_{base}$. For example, the relaxed width $w_{top}$ can be within ±10% of the base width $w_{base}$. As another example, the relaxed width $w_{top}$ can be equal to the base width $w_{base}$ within manufacturing tolerance. Accordingly, the inner cavity 246 can be configured to be cylindrical. For example, the inner cavity 246 can be configured as a right circular cylinder with circular top and bottom. As another example, the inner cavity 246 can be configured as an elliptic cylinder with oval top and bottom. As yet another example, the inner cavity 246 can be configured as a polyhedral prism (e.g., a square prism, a rectangular prism, a hexagonal prism, etc.) having a top and a bottom with substantially the same geometry such that a surface area of the top of the inner cavity configured as a polyhedral prism is substantially equal to a surface area of the bottom of the inner cavity configured as a polyhedral prism.

The outer sidewalls 228 can be configured to be tapered from the bottom base 220 towards the open top 224 such that a thickness of sidewalls 222 is reduced towards the open top along the longitudinal axis A-A. For example, as illustrated in FIG. 2L-3, the outer sidewalls 228 can be linearly tapered such that a thickness of the sidewalls 222 is reduced from the bottom base 220 towards the open top 224. It is noted that only the outer sidewalls 228 are tapered while the inner sidewalls 226 are not tapered. Accordingly, the width of the inner cavity 246 does not vary or remains substantially the same from the bottom base 220 to the open top 224. As a result of tapering the outer sidewalls 228, the sidewalls have a first thickness in the region 240 adjacent the open top 224 and a second thickness greater than the first thickness in the region 242 adjacent the bottom base 230. The first thickness in the region 240 can be greater than or equal to about 0.1 mm and less than or equal to about 1.0 mm and the second thickness in the region 242 can be greater than or equal to about 1.0 mm and less than or equal to about 5.0 mm. The progressive reduction in thickness of the outer sidewalls 228 from the bottom base 220 towards the open top 224 increases the flexibility of an upper portion as compared to the flexibility of a lower portion of the shielding cup. The increased flexibility of the upper portion due to the reduced sidewall thickness of the upper portion can allow the upper portion to deform (e.g., stretch or expand) so as to accommodate heel tips and/or heel posts of different sizes when the shielding cup is placed on the heel tips and/or heel posts. The higher mechanical resistance of the thicker sidewalls of the lower portion can provide forces along a direction perpendicular to the longitudinal axis to secure the shielding cup to the heel tips and/or heel posts. The increased sidewall thickness of the lower portion of the shielding cup can also provide stability while walking. Additionally, the increased sidewall thickness of the lower portion of the shielding cup can also provide mechanical stability to the shielding cup to sustain forces and pressures incurred when the heel tip strikes the ground during walking.

The upper portion of the shielding cup can include sidewalls having a thickness below a threshold thickness while the lower portion of the shielding cup can include sidewalls having a thickness above the threshold thickness. The threshold thickness can be in the range between 0.6 mm and about 1.0 mm. For example, in various embodiments the thickness of the sidewalls 222 in the upper portion of the shielding cup can be between about 0.1 mm and about 1.0 mm, such as, for example, greater than or equal to about 0.2 mm and less than or equal to about 0.6 mm, greater than or equal to about 0.25 mm and less than or equal to about 0.55 mm, greater than or equal to about 0.3 mm and less than or equal to about 0.5 mm or greater than or equal to about 0.35 mm and less than or equal to about 0.45 mm. In various embodiments, the thickness of the sidewalls 222 in the upper portion of the shielding cup can be less than 0.1 mm or greater than 1.0 mm.

As another example, in various embodiments the thickness of the sidewalls 222 in the lower portion of the shielding cup can be between about 0.8 mm and about 5.0 mm, such as, for example, greater than or equal to about 0.8 mm and less than or equal to about 5.0 mm, greater than or equal to about 0.9 mm and less than or equal to about 4.5 mm, greater than or equal to about 1.0 mm and less than or equal to about 4.0 mm, greater than or equal to about 1.5 mm and less than or equal to about 3.5 mm or greater than or equal to about 2.0 mm and less than or equal to about 3.0 mm. In various embodiments, the thickness of the sidewalls in the upper portion of the shielding cup can be configured to deform (e.g., expand, stretch or compress) when a force equivalent to a force created by an average human manually inserting the heel tip of a shoe into the cup is applied. The shielding cup can comprise an elastic material such that the upper sidewalls can elastically deform when the force is applied. Accordingly, the open top 224 and the upper portion of the shielding cup can return to their original shape and size when the force is removed. For example, the open top 224 can return to its original shape and relaxed width $w_{top}$ when the shielding cup is detached from or no longer applied to the heel tips and/or posts.

The length 'L' along the longitudinal axis A-A over which the outer sidewalls 228 are tapered also referred to herein as taper length can be at least about 3.75 times the difference in a thickness of the upper portion and a thickness of the lower portion. For example, the taper length 'L' can be at least about 3.75 times the difference between the smallest sidewall thickness in the upper portion and the largest sidewall thickness in the lower portion. As another example, the taper length 'L' can be at least about 3.75 times the difference between an average sidewall thickness of the upper portion and an average sidewall thickness of the lower portion. In some embodiments, the taper length can be greater than about 3.75 times the difference in a thickness of the upper portion and a thickness of the lower portion. For example, the taper length can be between about 4 times to about 10 times the difference in a thickness of the upper portion and a thickness of the lower portion. In some embodiments, the taper length can be less than about 3.75 times the difference in a thickness of the upper portion and a thickness of the lower portion. For example, the taper length can be between about 1.5 times to about 3 times the difference in a thickness of the upper portion and a thickness of the lower portion. The taper length is configured to distribute the tapering thickness along the length of the shielding cup such that it creates a distinct thin, flexible upper portion and a thicker, rigid lower portion such that the shielding cup can be attached to the heel tip by a press fit mechanism.

In various embodiments of the shielding cup, the base thickness (e.g., a distance between the inner surface 230 and the outer surface 232 of the bottom base 220 along the longitudinal axis A-A) can be between about 1 mm to about 5 mm. The depth of the inner cavity (e.g., a distance between a portion of the inner sidewalls 226 adjacent the open top 224 and a portion of the inner sidewalls 226 adjacent the inner surface 230) can be between about 9 mm and about 30 mm, such as, for example, between about 9 mm and about 15 mm, between about 10 mm and about 30 mm, between about 12 mm and about 25 mm, between about 15 mm and about 20 mm or a value in any of these ranges or sub-ranges. As discussed above, a width of the inner cavity 246 can be substantially uniform across the depth of the inner cavity. In various embodiments, the width of the inner cavity 246 can be between about 7 mm to about 18 mm to accommodate a wide range of heel sizes. Accordingly, the base width $w_{base}$ and the relaxed width of the open top $w_{top}$ can be in the range between about 7 mm to about 18 mm. The width of the open top $w_{top}$ can be larger than the base width $w_{base}$ when the upper portion of the shielding cup is deformed to apply the shielding cup to the heel tip.

The thickness of the upper portion and the lower portion of the sidewalls 222, the taper length L and other dimensions of the shielding cup are configured to provide a desired press fit engagement with the heel tip 12 and/or the heel post 14. For example, the upper portion with reduced sidewall thickness is flexible and facilitates positioning of the heel tip 12 and/or a portion of the heel post 14 into the inner cavity 246 during attachment of the shielding cup to the stiletto heel 16. As discussed above, the reduced sidewall thickness allows the walls to elastically deform to engage the periphery of the heel tip 12 and/or a portion of the heel post 14. Once the stiletto heel 16 is positioned in the inner cavity 246, the heel 16 can be pushed further into the inner cavity 246 to engage the thicker sidewalls of the lower portion of the shielding cup. The thicker sidewalls of the lower portion of the shielding cup can have higher mechanical resistance (e.g., higher stiffness or decreased flexibility) on account of the increased sidewall thickness which can advantageously provide a higher pressure or force against the heel tip 12 and/or the heel post 14 such that the shielding cup is secured to the heel 16. The higher mechanical resistance offered by the sidewalls of the lower portion of the shielding cup with increased thickness can advantageously press against the heel to create a tight press fit engagement. The press fit engagement is strongest near the bottom base 220 which experiences the most force during walking. The press fit engagement is further enhanced due to the geometry of a stiletto 10 where the width of the heel post increases from the heel tip 12 towards the base of the stiletto 10. Accordingly, when a heel is fully inserted into the shielding cup, the open top 224 tightly presses against the heel post 14, increasing the length of interference and strengthening the press fit engagement.

In addition to easy insertion and secure press fit attachment, the tapered outer sidewalls 228 can distribute stress evenly over the length of the sidewalls of the shielding cup. There can be a high level of stress generated on the bottom base of the shielding cup when the stiletto heel strikes the ground while walking. Distributing stress across the length of the sidewalls can advantageously prevent premature rupture of the bottom base and/or sidewalls of the shielding cup. In various embodiments, the transition region 244 between the inner sidewalls 226 and the inner surface 230 of the bottom base 220 can be curved to alleviate the stresses on the bottom base 220 and/or the sidewalls 222 while walking. The curved transition region 244 can reduce the amount of deflection that the sidewalls undergo as a result of the forces experienced while walking. In various embodiments, a radius of curvature of the transition region 244 can be between about 0.5 mm to about 0.75 mm.

FIG. 2L-4 is a top view of the embodiment **18*l* of the shielding cup illustrated in FIG. 2L-1. FIG. 2L-5 is a bottom view of the embodiment 18*l* of the shielding cup illustrated in FIG. 2L-1. As illustrated in FIG. 2L-5 the outer surface 232 of the bottom base 220 can include treads or grips configured to increase friction between the bottom surface of the bottom base 220 and the ground. The outer surface 232 can also include a region 234** where branding information, sizing information or any other information can be indicated.

Figures 1, 2M:
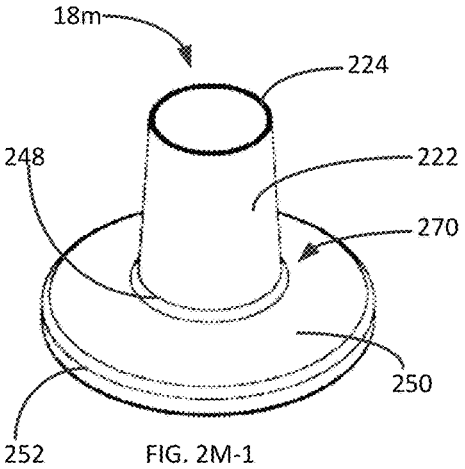
Figures 2, 2M, 3, 4, 5:
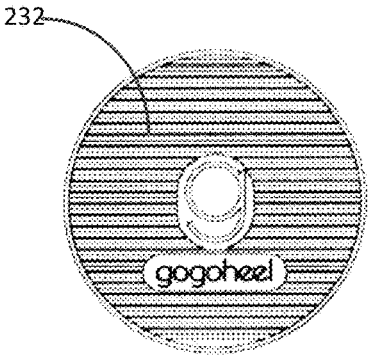
Figures 2, 2M:
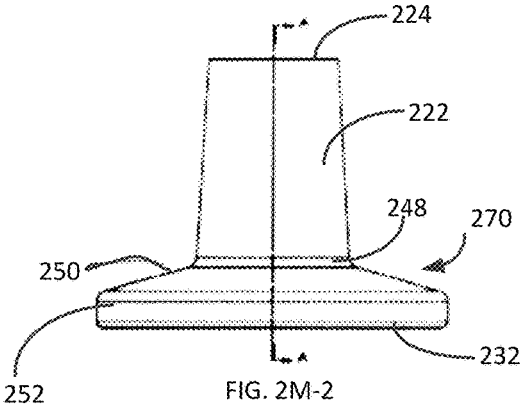
Figures 2, 2M, 3:
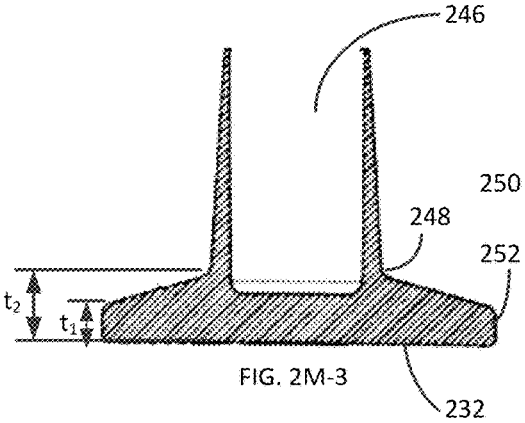
Figures 2, 2M, 3, 4:
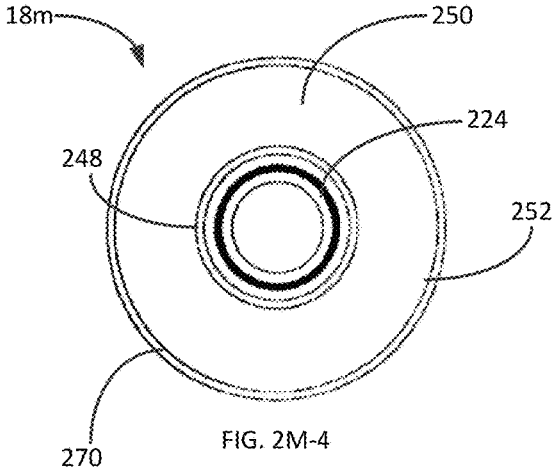
Figures 1, 2N:
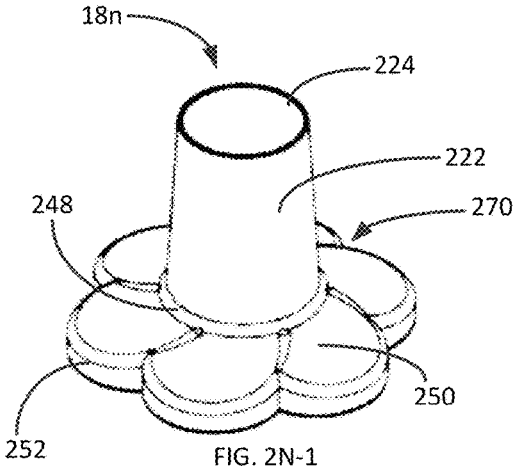
Figures 2, 2N, 3, 4, 5:
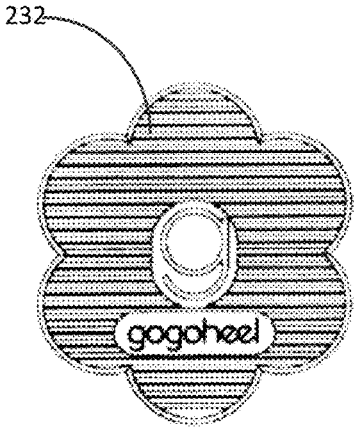
Figures 2, 2N:
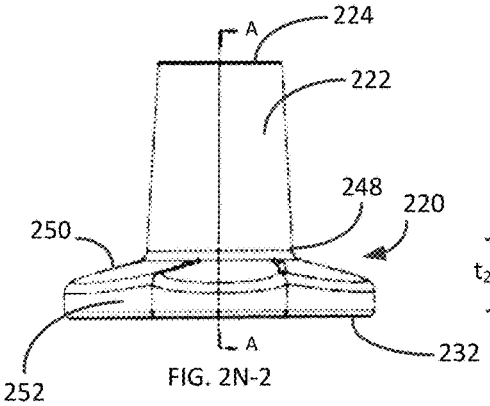
Figures 2, 2N, 3:
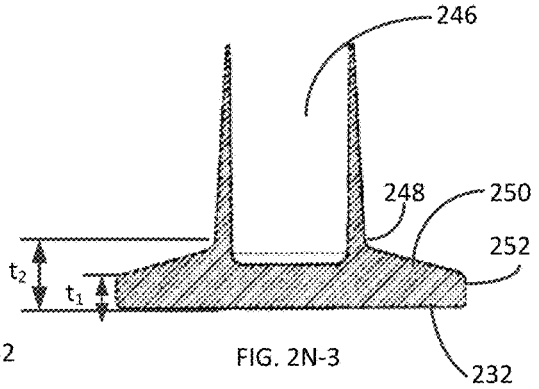
Figures 2, 2N, 3, 4:
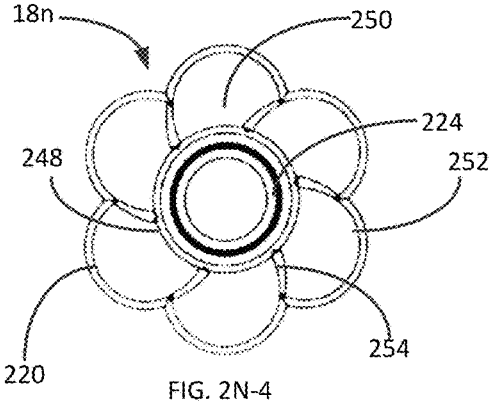

FIG. 2M-1 is a perspective view of an embodiment **18*m* of a shielding cup with tapered sidewalls and a widened base. FIG. 2M-2 is a side view of the embodiment 18*m* of the shielding cup illustrated in FIG. 2M-1. FIG. 2M-3 is a cross-sectional view of the embodiment 18*m* of the shielding cup illustrated in FIG. 2M-1. FIG. 2M-4 is a top view of the embodiment 18*m* of the shielding cup illustrated in FIG. 2M-1. FIG. 2M-5 is a bottom view of the embodiment 18*m* of the shielding cup illustrated in FIG. 2M-1. FIG. 2N-1 is a perspective view of an embodiment 18*n* of a shielding cup with tapered sidewalls and a widened flower-shaped base. FIG. 2N-2 is a side view of the embodiment 18*n* of the shielding cup illustrated in FIG. 2N-1. FIG. 2N-3 is a cross-sectional view of the embodiment 18*n* of the shielding cup illustrated in FIG. 2N-1. FIG. 2N-4 is a top view of the embodiment 18*n* of the shielding cup illustrated in FIG. 2N-1. FIG. 2N-5 is a bottom view of the embodiment 18*n* of the shielding cup illustrated in FIG. 2N-1. The embodiments 18*m* and 18*n* illustrated in FIGS. 2M-1 through 2M-5 and FIGS. 2N-1 through 2N-5 comprise an expanded bottom base 270, an open top 224 and sidewalls 222 extending from the bottom base 270 to the open top 224. The expanded bottom base 270 includes an inner periphery 248 that is adjacent the sidewalls 222 an outer periphery 252, a bottom surface 232 that contacts the ground or the floor and a surface 250 between the inner periphery 248 and the outer periphery 252**.

In various embodiments, the inner periphery 248 can have a width that is substantially equal to a width of the open top 224. For example, the inner periphery 248 can have a width that is within about ±10% of the width of the open top 224. In some embodiments, the inner periphery 248 can have a width that is greater than a width of the open top 224. For example, the inner periphery 248 can have a width between about 20% and about 50% larger than the width of the open top 224. The outer periphery 252 can have a width that is between about 1.5 and about 4.0 times the width of the inner periphery 248. For example, the outer periphery can have a width between about 1-1.5 inches. The expanded bottom base 270 provides a larger ground contacting surface 232 which can advantageously provide increased stability and support when walking on uneven surfaces and/or prevent sinking into softer ground. For example, the expanded bottom base 270 can provide increase stability and support when walking on grass, sand, or other soft/uneven surfaces. The outer periphery 252 can be circular as shown in FIGS. 2M-1 through 2M-5. However, in other embodiments, the outer periphery 252 can have shapes different from circular. For example, the outer periphery 252 can be flower-shaped as shown in FIGS. 2N-1 through 2N-5. The flower-shaped outer periphery 252 can comprise a plurality of petals. In various embodiments, grooves 254 can be provided between each of the plurality of petals. The shape of the outer periphery 252 can be selected to achieve a desired function or appearance. In various embodiments, the inner periphery 248 and/or the outer periphery 252 can be curved outward.

In some embodiments, the surface 250 can be inclined from the inner periphery 248 to the outer periphery 252 as shown in FIGS. 2M-2, 2M-3, 2N-2 and 2N-3. The surface 250 can be inclined such that a thickness of the bottom base 270 decreases from the inner periphery 248 to the outer periphery 252. For example, an inner thickness $t_2$ of the bottom base 270 between the inner periphery 248 and the outer surface 232, is greater than an outer thickness $t_1$ of the bottom base 270 between the outer periphery 252 and the outer surface 232. The inner thickness $t_2$ can be between about 5 mm and about 9 mm, in various embodiments. The outer thickness $t_1$ can be between about 2 mm to about 5 mm. The inclined surface between the inner periphery 248 and the outer periphery 252 can advantageously provide a large, rigid surface for walking on uneven and/or soft surfaces without sinking into the ground. Additionally, reducing the thickness of the bottom base 270 from the inner periphery 248 to the outer periphery 252 by inclining the surface 250 can reduce the mass of the shielding cup and/or enhance the aesthetic appearance of the shielding cup.

Many features of the embodiments **18*m* and 18*n* can be similar to the features of the embodiment 18*l* of the shielding cup described above with reference to FIG. 2L-1 through 2L-5. For example, the outer sidewalls 222 can be tapered from the bottom base 220 towards the open top 224 such that an upper portion of the shielding cup has increased flexibility as compared to a lower portion of the sidewalls. As another example, the inner cavity 246 can have substantially uniform width across the depth of the inner cavity 246**.

The various embodiments of the shielding cup illustrated in FIGS. 2L-1 through 2N-5 can be fabricated monolithically from a single material system having a uniform durometer value. However, other embodiments of the shielding cup illustrated in FIGS. 2L-1 through 2N-5 can be fabricated from different material systems having different durometer values as discussed above with reference to FIG. 2H.

Various embodiments of the shielding cup may be made from a transparent material, in different colors, and/or decorated with designs such as logos or various black and white or colorful patterns. The shielding cup may also contain a tracking device for purposes such as tracking number of steps, movement, or location. Such device may be able to communicate with other devices such as smart phones and/or computers.

Figure 6:
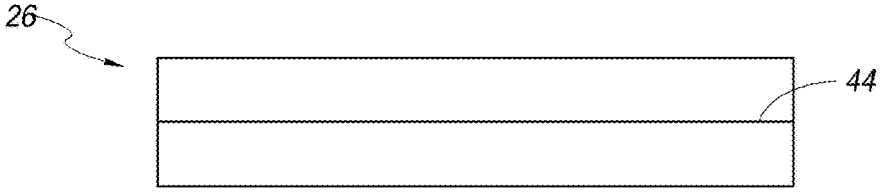
FIG. 6 is an elevational view of the elongate self-fusing member, shown with a guide line to indicate how to arrange it on the shielding cup and lower part of the heel.

In another embodiment shown in FIG. 3A, the shielding cup 18 is attached to the lower end of the heel by inserting the heel 16 into the cavity of the cup and securing it with an elongate self-fusing member 26. The self-fusing member 26 may be made of a self-fusing material, such as silicone, that readily binds to itself upon contact. In certain embodiments, the fusing is enhanced by cross-linking, which can be effectively provided when exposed to a catalyst. Other surface modifications such as plasma treatment or etching could also improve adhesion. The material does not damage the heel fabric after it is removed. The self-fusing member 26 may be attached to the cup 18, **18*a* or provided separately when assembled for commercial use. The cup 18, 18*a* is fastened to the lower end of the heel by stretching and contracting the self-fusing member 26 tightly around a portion of the cup 18, 18*a* and a portion of the heel 16 just above the top rim 23 of the cup 18, 18*a*. The self-fusing member 26 may have a visible guide line 44 shown in FIG. 6 to guide the user on how to divide the member between the cup 18,18*a* and a portion of the heel 16 just above the top rim 23 of the cup 18, 18*a*. Also, the side walls 22 of the cup 18, 18*a* may have marks in the form of one or more lines to indicate where a portion of the self-fusing member should be positioned. The self-fusing member 26 applies a circumferential and radial force around the top rim 23 and side walls 22 of the cup 18, 18*a*, enclosing the shielding cup 18, 18*a* around the heel 16. In some embodiments, the radial force can be about 5 lbs or more. The radial force provided can range from about 5 lbs to about 30 lbs. In certain embodiments, the radial force can be about 30 lbs or more. In one embodiment, stretching the self-fusing member 26 activates the self-fusing or self adhering property of the material, e.g., by cross-linking, and allows it to create a strong, tight hold for the cup 18, 18*a* and heel 16. In one method, the self-fusing member 26 is wrapped around the heel 16 for several revolutions to achieve a secure attachment. In one embodiment, an interface between two portions of the member 26 is provided of at least one full perimeter of the heel 16 to provide a secure engagement. Preferably the self-fusing member 26 overlaps both the shielding cup 18, 18*a* and heel 16** for at least a portion of its length.

In one technique, the self-fusing member 26 can be wrapped around the lower portion of the heel 16 to create a greater heel perimeter. This minimizes any space between the enclosed heel 16 and inner perimeter of the cup 18, **18*a* before attachment. This technique can expand the variety of shoe configurations with which embodiments can be used. An adhesive layer 24, as previously described and shown in FIG. 3B, may be used to further secure the cup 18, 18*a* to the heel 16**.

In another embodiment of the shielding cup **18*g* shown in FIGS. 2J and 2K, the outer portion of the side walls 22 of the cup may have ridges, grooves or any friction-enhancing surface to help grip and secure the inner surface of the elongate self-fusing member 26 to both an outer surface of the shoe 10 and side walls 22 of the cup. This prevents the self-fusing member 26 from slipping and loosening after attachment, especially when there is increased force on the cup 18 or the heel 16 such as when running, driving, or walking downhill. This friction-enhancing surface or structure 27 can be disposed on the same location, e.g., the same plane as the top rim 23 of the cup or in between the top rim 23 and the base 20. The friction-enhancing structure 27 can be in the form of protrusions (e.g., ridges, bumps or lips), depressions (e.g., groove or cuts), or any other surface deformations that promote friction. The height of the protrusions from the side wall(s) 22 of the cup to the crest of the protrusion can range from approximately 0.2 mm to 1 mm. The depth of the depressions from the side wall 22 to the bottom of the depression can range from approximately 0.05 mm to 0.75 mm. These structures 27 can have sharp or rounded edges and can be made of rigid or more flexible material. Additionally, the friction-enhancing surface can either be a uniform or randomly shaped structure(s) along the perimeter of the side wall(s) 22 of the cup 18**.

The slits 25 previously discussed and shown in FIG. 2D may be used with the embodiment shown in FIG. 3A to enhance the flexibility of the upper portion of the cup 18*b* so it can accommodate a range of heel sizes. The slits 25 may be contiguous with the edge of the cup's top rim 23 or in between the edge of the top rim 23 and the base 20. Other techniques for enhancing the flexibility of an upper portion of the cup 18, 18*a* can also be used rather than the slits 25, such as using a low durometer material for the side walls 22.

B. Heat-Shrink Shielding Cup and Method for Attachment

Figure 4A:
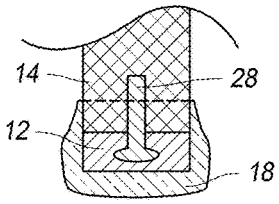
FIG. 4A is a cross sectional view of one embodiment of a cup structure configured to shrink into engagement with a lower part of the heel.
Figure 4B:
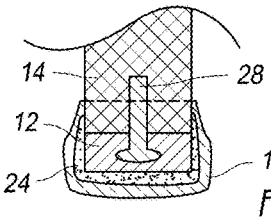
FIG. 4B is a cross sectional view of the shrinkable shielding cup embodiment in FIG. 4A, shown with an adhesive layer applied to the base and lower portions of the cup's side walls.

Another embodiment of the invention is illustrated in FIGS. 4A and 4B. The shielding cup 18, 18*a* is made of a heat-shrink material and attaches to the heel 16 by applying heat to the cup 18, 18*a*, thereby shrinking the cup to conform to the size and shape of the underlying heel 16. When heated, the heat-shrink cup 18, 18*a* creates a tight seal around the heel tip 12. The shrinking of the cup 18, 18*a* also provides a sufficient mechanical connection between the cup 18, 18*a* and the heel 16 to endure at least a short period of use, such as one or several days, until other more permanent repairs can be made. The heat shrinking embodiments can generate similar forces to those set forth above in connection with the use of the elongate self-fusing member 26.

The heat-shrink cup may be manufactured from a thermoplastic material such as polyolefin, fluoropolymer (such as FEP, PTFE or Kynar), PVC, polyvinyl chloride, neoprene, silicone elastomer or Viton. The shrink temperature of the cup 18, 18*a* is typically close to or at least 140 degrees Fahrenheit, or 60 degrees Celsius, so that a consumer is able to use this embodiment with a hot air hair dryer, a standard household good. Shrink tubing with higher temperatures are also possible and require heat sources with higher temperatures. The shrink ratio of the material preferably is about 3:1 but in some embodiments a ratio of about 2:1 is adequate. The thickness and height range of the walls can be identical to the previous embodiment. The base of the cup is typically about 1 mm to about 4 mm in thickness and has a diameter (or width) ranging from about 13 mm to about 22 mm. The thickness of the side walls 22 may be uniform or tapered, for example, having a varying dimension along a direction that extends upwardly toward the open top of the shielding cup 18, 18*a*. Additionally, the side walls 22 can taper or angle inward toward the center.

FIG. 4A shows the heat shrink cup 18, 18*a* attached to the heel tip 12 and the bottom portion of a heel post 14 after it has shrunk to its final configuration. An adhesive layer 24, as previously described, may be used to further secure the heat-shrink cup 18, 18*a* to the heel 16. FIG. 4B shows the heat-shrink embodiment similar to FIG. 4A, but with the adhesive layer 24.

Figure 5A:
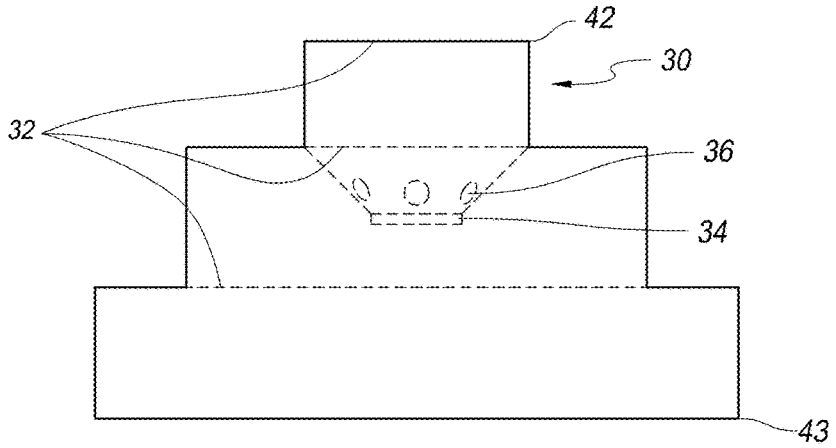
FIG. 5A is a perspective view of the collapsible heat-concentrating accessory in an expanded position.
Figure 5B:
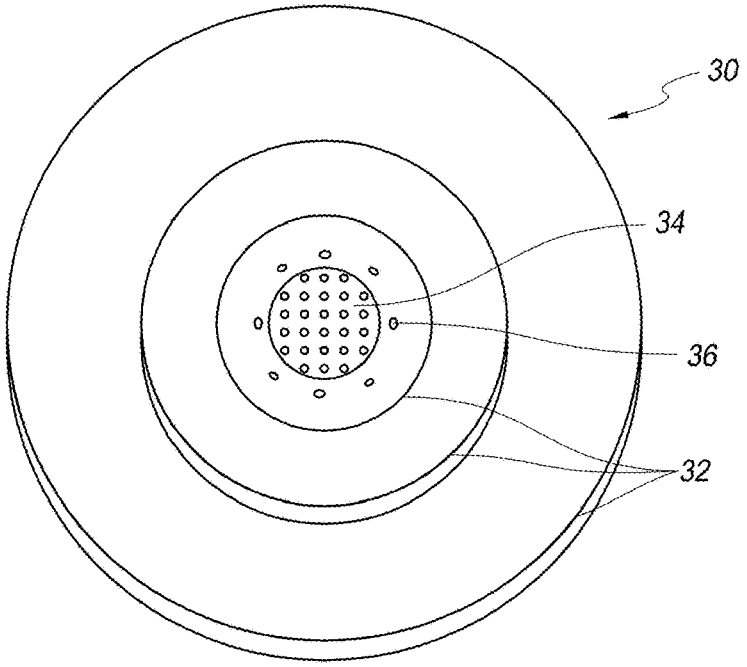
FIG. 5B is an elevational view of the collapsible heat-concentrating accessory in a collapsed position.

In the foregoing embodiments, the cup 18, 18*a* is configured to shrink upon application of heat. While this is a preferred configuration for shrinking the cup 18, 18*a* other modes for triggering and/or fully completing constriction of the cup 18, 18*a* onto the heel are possible; any heating source that will create a directed temperature of 60 degrees Celsius may be used. FIGS. 5A and 5B illustrate a collapsible heat-concentrating accessory 30 for directing heat at the cup 18, 18*a*. The accessory 30 can be used with a blow dryer. The accessory 30 can be used to concentrate hot air to achieve the minimum temperature required to activate the heat-shrink cup 18, 18*a*. The accessory 30 has an inverted narrow end 42 and is made of a flexible, heat-resistant material, such as silicone. The accessory 30 has concentric accordion pleats 32 allowing it to take on various configurations when expanded and collapsed. An expanded structure is illustrated in FIG. 5A and a collapsed structure is shown in FIG. 5B. Other heat sources such as radiation heating or other methods known to those skilled in the art are also possible.

As shown in FIG. 5A, the typical configuration of the collapsible heat-concentrating accessory 30 when expanded for heat-shrinking is a cone shape where the narrower half of the cone is folded into itself, forming a V-shape when viewed from the side. In use, the mouth of the blow dryer is placed in the wider opening 43 of the accessory 30, and when the blow dryer is switched on, the airflow is concentrated to the narrow opening 42 of the accessory 30.

The narrow opening 42 of the collapsible heat-concentrating accessory 30 has a mesh screen or crisscross pattern 34 in the material that can serve as a resting plate for the cup 18, 18*a* and a positioning device to prevent the cup 18, 18*a* from falling through the accessory 30. Additionally, the accessory 30 has air vents 36 surrounding the rim of the narrow opening 42 of the accessory 30 which are used to deliver heat higher up to the side wall(s) 22 of the cup 18, 18*a*. These air vents 36 allow the hot air to flow in a multidirectional pattern rather than solely in an upward direction from the narrow opening 42.

The heat shrink material is very durable after shrinking, providing a strong attachment to a heel, and is discreet because it conforms to a heel's shape and size. Additionally, the heat-shrink cup has a quick application time, such as less than a minute, and can potentially have a lifespan equivalent to that of a heel tip. For these reasons, this embodiment can rival a permanent heel tip replacement and potentially become the primary solution to heel tip replacement.

In various embodiments, the shielding cup may be circular, horseshoe, or any other shape given to high heels. Additionally, the shielding cup and elongate member may be made in different colors and may be decorated with designs such as logos or various black and white or colorful patterns.

What is claimed is:

1. An apparatus that attaches to a stiletto heel to cover the tip of the heel, comprising:

a shielding cup having a bottom base, sidewalls extending away from the bottom base to an open top that serves as the receiving end of the cup, said sidewalls having an inner circumference and a variable outer circumference, said bottom base having an inner surface and outer surface, the inner surface of the bottom base and the inner circumference of the sidewalls bounding an inner cavity comprising the open top; and a graduated press-fit arrangement for attaching the shielding cup to the heel, the arrangement including tapering the thickness of the sidewalls by linearly varying the outer circumference, said taper extending most of the length between the open top and inner surface of the bottom base so that the sidewall thickness near the open top is less than the sidewall thickness near the bottom base, wherein the length of the linear taper is at least about 3.75 times the difference between the sidewall thickness adjacent the open top and the sidewall thickness adjacent the bottom base of said tapered section such that the open top is capable of greater deflection to accommodate a heel with a width larger than an inner width of the open top and the sidewalls toward the bottom base are capable of lesser deflection to bring the heel and sidewalls into a tight, direct press-fit engagement with each other, wherein a width of the inner cavity near the open top is greater than or equal to a width of the inner cavity near the bottom base, and wherein the shielding cup is rotationally symmetric about a longitudinal axis passing through the open top and the bottom base.

2. The apparatus of claim 1, wherein said shielding cup material comprises a high durometer polyurethane or other abrasion resistant material.

3. The apparatus of claim 1, wherein a depth of said shielding cup from the inner surface of the bottom base to an edge of the sidewall coplanar with the open top is about 9 mm to about 15 mm.

4. The apparatus of claim 1, wherein the sidewall thickness of the open top is about 0.2 mm to about 0.6 mm and the sidewall thickness near the bottom base is about 1 mm to about 3 mm.

5. The apparatus of claim 1, wherein the sidewalls of the shielding cup near the open top comprise a lower durometer material than the sidewalls of the shielding cup near the bottom base.

6. The apparatus of claim 1, further comprising an adhesive disposed on at least one of the inner circumference of the sidewalls, the inner surface of the bottom base, or both the inner circumference of the sidewalls and the inner surface of the bottom base.

7. The apparatus of claim 1, wherein the open top has an outer perimeter not smaller than an outer perimeter of the base.

8. The apparatus of claim 1, wherein the open top has an outer perimeter smaller than an outer perimeter of the bottom base.

9. The apparatus of claim 8, further comprising a second linear taper on the exterior side of the shielding cup forming the upper section of the bottom base.

10. The apparatus of claim 8, wherein the base width is about 1 inch to 1.5 inches.

11. The apparatus of claim 1, wherein a depth of said shielding cup from the inner surface of the bottom base to an edge of the sidewall coplanar with the open top is about 10 mm to about 30 mm.

12. The apparatus of claim 1, wherein the difference between the sidewall thickness adjacent the open top and the sidewall thickness adjacent the bottom base is obtained by taking a difference between an average thickness of the portion of the sidewalls adjacent to the open top and an average thickness of the portion of the sidewalls adjacent to the bottom base.

13. The apparatus of claim 1, wherein the difference between the sidewall thickness adjacent the open top and the sidewall thickness adjacent the bottom base is obtained by taking a difference between a smallest thickness of the portion of the sidewalls adjacent to the open top and a largest thickness of the portion of the sidewalls adjacent to the bottom base.

14. The apparatus of claim 1, wherein a difference between the width of the inner cavity near the open top and the width of the inner cavity near the bottom base is less than or equal to 10%.

15. A method of optimizing press fit engagement between a high heel cup and a heel of a stiletto shoe, comprising:

forming a high heel cup comprising an interior sidewall, an exterior sidewall, a bottom base and an open top by linearly tapering the exterior sidewall of the high heel cup to form a tapered cantilever structure such that the thickness of the fixed end near the bottom base is at least twice the thickness of the free end forming the open top and the length of the linear taper is at least about 3.75 times the difference between the sidewall thickness adjacent the open top and the sidewall thickness adjacent the bottom base of said tapered section to form a distinct upper flexible section capable of greater deflection and a lower rigid section capable of less deflection along the tapered length, wherein:

the high heel cup comprises an inner cavity configured to receive a heel of a stiletto shoe, the inner cavity bounded by the interior sidewall and the bottom base, wherein a width of the inner cavity near the open top is greater than or equal to a width of the inner cavity near the bottom base, and wherein the high heel cup is rotationally symmetric about a longitudinal axis passing through the open top and the bottom base, such that, as a heel with a width larger than the inner width of the open top is inserted into the open top, the sidewalls deflect and bend such that it encloses the tip of the heel, and as said heel is pushed further into the cup, it presses against the more rigid and thicker sidewall section to bring the heel and sidewalls into a tight press-fit engagement with each other, whereby said high heel cup will be securely attached to said tip of a high heel shoe.

16. The method of claim 15, wherein the open top has an outer perimeter not smaller than an outer perimeter of the base.

17. The method of claim 15, wherein the open top has an outer perimeter smaller than an outer perimeter of the base.

18. The method of claim 17, further comprising a second linear taper on the exterior side of the shield cup forming an upper section of the bottom base.

19. The method of claim 17, wherein the base width is about 1 inch to 1.5 inches.

20. The method of claim 17, wherein a depth of said shielding cup from the inner surface of the bottom base to an edge of the sidewall coplanar with the open top is about 10 mm to about 30 mm.

21. The method of claim 15, wherein the difference between the sidewall thickness adjacent the open top and the sidewall thickness adjacent the bottom base is obtained by taking a difference between an average thickness of the portion of the sidewalls adjacent to the open top and an average thickness of the portion of the sidewalls adjacent to the bottom base.

22. The method of claim 15, wherein the difference between the sidewall thickness adjacent the open top and the sidewall thickness adjacent the bottom base is obtained by taking a difference between a smallest thickness of the portion of the sidewalls adjacent to the open top and a largest thickness of the portion of the sidewalls adjacent to the bottom base.

23. The method of claim 15, wherein a difference between the width of the inner cavity near the open top and the width of the inner cavity near the bottom base is less than or equal to 10%.

24. A shielding cup configured to be attached to a stiletto heel tip, the cup comprising:

an open top;

a bottom base having an inner surface and an outer surface;

sidewalls extending from the bottom base to the open top, the sidewalls having an inner surface and an outer surface; and an inner cavity bounded by the inner surface of the sidewalls and the inner surface of the bottom base, the inner cavity configured to receive the heel tip through the open top, wherein a portion of the sidewalls adjacent to the open top is configured to be more flexible than a portion of the sidewalls adjacent to the bottom base by tapering the sidewalls from the bottom base to the open top such that a thickness of the portion of the sidewalls adjacent to the open top is smaller than a thickness of the portion of the sidewalls adjacent to the bottom base, and wherein an inner perimeter of the inner cavity near the open top is greater than or equal to the inner perimeter of the inner cavity near the bottom base, and wherein the shielding cup is rotationally symmetric about a longitudinal axis passing through the open top and the bottom base.

25. The shielding cup of claim 24, wherein a taper length over which the outer surface of the sidewalls tapers is substantially equal to the depth of the inner cavity.

26. The shielding cup of claim 25, wherein the taper length is between about 1.5 times and about 25 times the difference between an average thickness of the portion of the sidewalls adjacent to the open top and an average thickness of the portion of the sidewalls adjacent to the bottom base.

27. The shielding cup of claim 25, wherein the taper length is between about 1.5 times and about 25 times the difference between a smallest thickness of the portion of the sidewalls adjacent to the open top and a largest thickness of the portion of the sidewalls adjacent to the bottom base.

28. The shielding cup of claim 24, wherein the depth of the inner cavity is between about 9.0 mm and about 15.0 mm.

29. The shielding cup of claim 24, wherein the thickness of the portion of the sidewalls adjacent to the open top is between about 0.2 mm and about 0.6 mm.

30. The shielding cup of claim 24, wherein the thickness of the portion of the sidewalls adjacent to the bottom base is between about 1.0 mm and about 3.0 mm.

31. The shielding cup of claim 24, wherein the outer surface of the bottom base extends from an inner periphery adjacent the outer surface of the sidewalls to an outer periphery surrounding the inner periphery.

32. The shielding cup of claim 31, wherein the inner periphery has a width that is substantially equal to a width of an outer perimeter of the open top.

33. The shielding cup of claim 31, wherein the inner periphery has a width that is about 10% to about 30% larger a width of an outer perimeter of the open top.

34. The shielding cup of claim 31, wherein the outer periphery has a width that is about 1.5-4 times the width of the inner periphery.

35. The shielding cup of claim 31, wherein the outer surface is inclined from the inner periphery towards the outer periphery such that a thickness of the inner periphery and a ground contacting surface of the bottom base is greater than a thickness of outer periphery and the ground contacting surface.

36. The shielding cup of claim 24, wherein a difference between the width of the inner cavity near the open top and the width of the inner cavity near the bottom base is less than or equal to 10%.

37. A shielding cup configured to be attached to a stiletto heel tip, the cup comprising:

a bottom base having an inner surface and an outer surface;

an open top with an outer perimeter smaller than an outer perimeter of the bottom base;

sidewalls extending from the bottom base to the open top, the sidewalls tapering such that a thickness of the portion of the sidewalls adjacent to the open top is smaller than a thickness of the portion of the sidewalls adjacent to the bottom base; and an inner cavity bounded by the inner surface of the sidewalls and the inner surface of the bottom base, the inner cavity configured to receive the heel tip through the open top, wherein the outer surface of the bottom base extends from an inner periphery adjacent the outer surface of the sidewalls to an outer periphery surrounding the inner periphery, and the outer surface is inclined from the inner periphery towards the outer periphery such that a thickness of the inner periphery and a ground contacting surface of the bottom base is greater than a thickness of outer periphery and the ground contacting surface, and wherein an inner perimeter of the inner cavity near the open top is greater than or equal to the inner perimeter of the inner cavity near the bottom base, and wherein the shielding cup is rotationally symmetric about a longitudinal axis passing through the open top and the bottom base.

38. The shielding cup of claim 37, wherein a difference between the width of the inner cavity near the open top and the width of the inner cavity near the bottom base is less than or equal to 10%.

* * * * *